US009211547B2

(12) United States Patent
Latta et al.

(10) Patent No.: US 9,211,547 B2
(45) Date of Patent: Dec. 15, 2015

(54) CLASSIFIER

(71) Applicant: LP Amina LLC, Charlotte, NC (US)

(72) Inventors: William Latta, Mooresville, NC (US); Changchun Wu, Sichuan (CN); Matthew Targett, Sarasota, FL (US)

(73) Assignee: LP AMINA LLC, Charlotte, NC (US)

( * ) Notice: Subject to any disclaimer, the term of this patent is extended or adjusted under 35 U.S.C. 154(b) by 0 days.

(21) Appl. No.: 14/163,773

(22) Filed: Jan. 24, 2014

(65) Prior Publication Data

US 2014/0203121 A1 Jul. 24, 2014

Related U.S. Application Data

(60) Provisional application No. 61/756,173, filed on Jan. 24, 2013.

(51) Int. Cl.
*B07B 7/08* (2006.01)
*B02C 23/12* (2006.01)
(Continued)

(52) U.S. Cl.
CPC . *B02C 23/12* (2013.01); *B07B 7/02* (2013.01); *B02C 2015/002* (2013.01); *B07B 7/086* (2013.01)

(58) Field of Classification Search
CPC ..... B07B 7/08; B07B 7/083; B07B 7/10; B02C 23/08; B02C 23/10; B02C 23/12; B04C 5/14
USPC ..... 209/138, 139.1, 142, 143, 154, 713, 209/714, 715, 718, 720; 241/79, 80
See application file for complete search history.

(56) References Cited

U.S. PATENT DOCUMENTS 22,395 A 12/1858 Woodward
321,379 A 6/1885 Mumford et al.
(Continued)

FOREIGN PATENT DOCUMENTS

CN 2289608 Y 9/1998
CN 200954454 Y 10/2007
(Continued)

OTHER PUBLICATIONS

International Search Report for PCT/US2014/013058 dated—Jan. 24, 2014.
(Continued)

*Primary Examiner* — Joseph C Rodriguez
(74) *Attorney, Agent, or Firm* — Foley & Lardner LLP

(57) ABSTRACT

A classifier including a housing, a body, a vane assembly, and an outlet. The housing extends along a longitudinal axis between opposing first and second ends, and includes a lower portion provided at the first end and including an inlet, an upper portion provided at the second end and including a reclaim outlet, and an intermediate portion provided between the upper and lower portions. The body is disposed within the housing that defines a chamber therebetween. The vane assembly includes a plurality of blades and is provided between an outer surface of the body and an inner surface of the intermediate portion dividing the chamber into first and second chambers. The outlet is provided at the second end and is fluidly connected to the second chamber to allow fine particles separated from coarse particles to flow through the outlet. The reclaim outlet is fluidly connected with the second chamber and a pulverizer to allow coarse particles separated from the fluid flow to be directed back to the pulverizer.

18 Claims, 16 Drawing Sheets

(51) Int. Cl.

| | |
|---|---|
| ***B07B 7/02*** | (2006.01) |
| *B02C 15/00* | (2006.01) |
| *B07B 7/086* | (2006.01) |

(56) References Cited

U.S. PATENT DOCUMENTS 325,521 A 9/1885 Finch
450,372 A 4/1891 Morse
575,807 A 1/1897 Johnson
630,023 A 8/1899 Baker
723,224 A 3/1903 Matthiessen
919,291 A 4/1909 Moodie
1,146,633 A * 7/1915 Lyons ..... 209/139.2
1,367,636 A 2/1921 Sturtevant
1,384,929 A 7/1921 Sturtevant
1,385,847 A 7/1921 Sturtevant
1,457,110 A 5/1923 Gay
1,470,892 A 10/1923 Sturtevant
1,517,900 A 12/1924 Gay
1,525,249 A 4/1925 Mastenbrook
1,572,041 A 2/1926 Rogers
1,595,259 A 8/1926 Stebbins
1,629,594 A 5/1927 Stebbins
1,698,361 A 1/1929 Dreisbach
1,709,848 A 4/1929 Hardinge
1,721,594 A 7/1929 Hardinge
1,735,298 A 11/1929 Pfeffer
1,784,882 A 12/1930 Rogers
1,795,162 A 3/1931 Bradley
1,801,857 A 4/1931 Gaus et al.
1,834,094 A 12/1931 Fraser
1,834,095 A 12/1931 Fraser
1,917,643 A 7/1933 Goldkamp
1,933,606 A 11/1933 Sturtevant
1,950,069 A 3/1934 Stein
1,958,726 A 5/1934 Sturtevant
1,962,450 A 6/1934 Lykken
1,968,053 A 7/1934 Odell
2,010,128 A 8/1935 Arnold
2,026,833 A 1/1936 Holland-Letz
2,030,612 A 2/1936 Sturtevant
2,082,242 A 6/1937 Bowen
2,087,789 A 7/1937 Allardice
2,091,087 A 8/1937 Wempe
2,109,477 A 3/1938 Gay
2,109,478 A 3/1938 Gay
2,147,911 A 2/1939 Menk
2,188,634 A 1/1940 Sturtevant
2,206,981 A 7/1940 Sturtevant
2,252,581 A 8/1941 Saint-Jacques
2,269,412 A 1/1942 Sturtevant
2,276,761 A 3/1942 Carey
2,313,256 A 3/1943 Morgan
2,329,900 A 9/1943 Hermann
2,367,906 A 1/1945 Wall et al.
2,381,954 A 8/1945 Hardinge
2,472,777 A 6/1949 Putney
2,505,957 A 5/1950 Geffroy
2,553,175 A 5/1951 Davenport et al.
2,561,564 A 7/1951 Crites
2,582,423 A 1/1952 Foley
2,638,217 A 5/1953 Niemitz
2,673,787 A 3/1954 Greenwalt
2,689,689 A 9/1954 Engler
2,741,366 A 4/1956 Lykken
2,753,996 A 7/1956 Kaiser
2,758,713 A 8/1956 Hardinge
2,848,473 A 8/1958 Rummel et al.
2,875,959 A 3/1959 Calkins
2,968,401 A 1/1961 Sheldon
3,015,391 A 1/1962 Sharples
3,015,392 A 1/1962 Rozsa et al.
3,036,709 A 5/1962 Mansson et al.
3,040,888 A 6/1962 Hosokawa et al.
3,042,202 A 7/1962 Work
3,219,185 A 11/1965 Doyle
3,234,716 A * 2/1966 Sevin et al. ..... 210/360.1
3,312,342 A 4/1967 Brown
3,423,034 A 1/1969 Hippert
3,426,513 A 2/1969 Bauer
3,433,422 A 3/1969 Guenther
3,448,563 A 6/1969 Sobeck
3,467,036 A 9/1969 Garrett, Jr.
3,476,244 A 11/1969 Schauer
3,483,973 A 12/1969 Jager
3,503,502 A 3/1970 Donelson, Jr.
3,520,114 A 7/1970 Pall et al.
3,520,407 A 7/1970 Rumpf et al.
3,590,560 A 7/1971 Pall et al.
3,611,679 A 10/1971 Pall
3,615,008 A 10/1971 Alpha
3,651,941 A 3/1972 Imris
3,670,886 A 6/1972 Hosokawa et al.
3,707,068 A 12/1972 Bloom
3,720,313 A 3/1973 Lapple
3,734,287 A 5/1973 Jager
3,770,124 A 11/1973 Frangquist
3,818,637 A 6/1974 Vivier
3,885,933 A 5/1975 Putney
3,951,620 A 4/1976 Frischmuth, Jr.
3,960,714 A 6/1976 Strauss
4,008,059 A 2/1977 Monson et al.
4,221,655 A 9/1980 Nakayama et al.
4,238,210 A 12/1980 Regehr et al.
4,251,368 A 2/1981 Colman et al.
4,260,478 A 4/1981 Hosokawa et al.
4,266,673 A * 5/1981 Haidlen et al. ..... 209/139.1
4,296,864 A 10/1981 Misaka et al.
4,339,086 A 7/1982 Brundiek
4,450,071 A 5/1984 Trozzi
4,470,902 A 9/1984 Yoshimori
4,473,478 A 9/1984 Chivrall
4,504,018 A 3/1985 Diggins
4,528,092 A 7/1985 Krambrock et al.
4,551,241 A 11/1985 Saverse et al.
4,641,788 A 2/1987 Williams
4,653,699 A 3/1987 Schlessing
4,661,244 A 4/1987 Hanke et al.
4,693,811 A 9/1987 Lohnherr
4,743,363 A 5/1988 Darrow
4,756,729 A 7/1988 Brunnmair et al.
4,792,393 A 12/1988 Blasczyk et al.
4,799,595 A 1/1989 Binder
4,818,376 A 4/1989 Tanaka et al.
4,853,112 A 8/1989 Brown
4,869,786 A 9/1989 Hanke
4,872,973 A 10/1989 Ikebuchi et al.
4,885,832 A 12/1989 English
4,935,123 A 6/1990 Csillag et al.
4,971,518 A 11/1990 Florin
5,025,930 A 6/1991 Barthelmess
5,032,222 A 7/1991 Millioud
5,055,182 A 10/1991 Lohnherr
5,120,431 A 6/1992 Cordonnier
5,165,549 A 11/1992 Kanda et al.
5,180,257 A 1/1993 Narishima et al.
5,262,046 A 11/1993 Forgac et al.
5,279,466 A 1/1994 Williams
5,366,095 A 11/1994 Martin
5,511,668 A * 4/1996 Keuschnigg ..... 209/135
5,605,292 A 2/1997 Bunton
5,681,450 A 10/1997 Chitnis et al.
5,690,709 A 11/1997 Barnes
5,788,727 A 8/1998 Barthelmess
5,819,947 A 10/1998 Nardi et al.
5,853,443 A 12/1998 Rodgers et al.
5,884,776 A 3/1999 Piepho et al.
5,885,333 A 3/1999 Dix
5,904,307 A * 5/1999 Prairie et al. ..... 241/117
5,934,483 A * 8/1999 Kolacz ..... 209/714
5,938,045 A 8/1999 Makino et al.
5,944,270 A 8/1999 Farris
5,957,300 A 9/1999 Nardi et al.
5,958,094 A 9/1999 Schwamborn et al.

(56) References Cited

U.S. PATENT DOCUMENTS

| | | | | |
|---|---|---|---|---|
| 6,276,534 | B1 | 8/2001 | Huang et al. | |
| 6,752,845 | B2 | 6/2004 | Haland | |
| 6,797,026 | B2 | 9/2004 | Sechrist et al. | |
| 6,827,221 | B1 * | 12/2004 | Brundiek et al. | 209/210 |
| 6,902,126 | B2 | 6/2005 | Chen et al. | |
| 7,156,889 | B1 | 1/2007 | Swanson et al. | |
| 7,316,733 | B1 | 1/2008 | Hedrick et al. | |
| 7,448,565 | B2 | 11/2008 | Farris | |
| 7,712,611 | B2 | 5/2010 | Longhurst et al. | |
| 7,896,937 | B2 | 3/2011 | Miemiec | |
| 8,033,399 | B2 | 10/2011 | Pistorius et al. | |
| 8,034,143 | B2 | 10/2011 | Tan et al. | |
| 8,097,059 | B2 | 1/2012 | Crafts | |
| 8,100,269 | B2 | 1/2012 | Taketomi et al. | |
| 8,101,001 | B2 | 1/2012 | Qian | |
| 8,137,446 | B2 | 3/2012 | Plamondon et al. | |
| 8,152,882 | B2 | 4/2012 | Wolsfeld | |
| 8,453,846 | B2 * | 6/2013 | Baetz et al. | 209/721 |
| 8,820,535 | B2 * | 9/2014 | Wark | 209/139.1 |
| 2003/0075486 | A1 | 4/2003 | Sussegger et al. | |
| 2005/0011170 | A1 | 1/2005 | Christiansen et al. | |
| 2006/0049288 | A1 | 3/2006 | Kronz | |
| 2006/0113225 | A1 | 6/2006 | Chang | |
| 2008/0006011 | A1 | 1/2008 | Larnholm et al. | |
| 2009/0242676 | A1 | 10/2009 | Fuller | |
| 2011/0308437 | A1 | 12/2011 | Latta et al. | |
| 2012/0012687 | A1 | 1/2012 | Vierstra | |
| 2013/0152522 | A1 | 6/2013 | Stippich et al. | |

FOREIGN PATENT DOCUMENTS

| | | | |
|---|---|---|---|
| CN | 101380631 | A | 3/2009 |
| CN | 203196691 | U | 9/2013 |
| GB | 634732 | A | 3/1950 |
| GB | 2067094 | A | 7/1981 |
| SU | 177766 | | 12/1965 |
| WO | WO2007129276 | | 11/2007 |

OTHER PUBLICATIONS

Tsai et al., Theoretical and Experimental Study of an Axial Flow Cyclone for Fine Particle Removal in Vacuum Conditions, Aerosol Science 35 (Mar. 19, 2004) pp. 1105-1118.

Zhongchao et al., Comparison of Two Models for Particle Separation in a Vane-Induced Uniflow Cyclone, ASHRAE Transactions: Research (2005) pp. 178-183.

Morales et al., Modeling of Free Surface Flow in a Helical Channel with Finite Pitch, J. of the Braz. Soc. of Mech. Sci. & Eng., Oct.-Dec. 2007, vol. XXIX, No. 4, pp. 345-353.

* cited by examiner

PARTICLES TRAJECTORY FOR PARTICLES BELOW 200 μm

PARTICLES TRAJECTORY FOR PARTICLES ABOVE 200 μm

CLASSIFIER

CROSS-REFERENCE TO RELATED PATENT APPLICATIONS

This application claims the benefit of and priority to U.S. Provisional Application No. 61/756,173, which was filed on Jan. 24, 2013. The foregoing U.S. provisional application is incorporated by reference herein in its entirety.

BACKGROUND

The present application relates generally to classifiers for use in the separation of particles of a substance according to size, density, or mass. More specifically, the present application relates to classifiers configured to more accurately separate the solid particles of a substance, such as a fuel (e.g., coal) to make the combustion of the fuel in a downstream process or device more efficient and to reduce undesirable emissions, or for other substances used in other industries, such as the solid particles used to form cement.

SUMMARY

One embodiment of this application relates to a classifier for separating fine and coarse particles in a fluid flow. The classifier includes a housing, a body, a vane assembly, and an outlet. The housing extends along a longitudinal axis between a first end and an opposing second end. The housing includes a lower portion provided at the first end and including an inlet for receiving the fluid flow, an upper portion provided at the second end and including a reclaim outlet, and an intermediate portion provided between the upper and lower portions. The body is disposed within the housing that defines a chamber between the body and the housing. The vane assembly is provided between an outer surface of the body and an inner surface of the intermediate portion of the housing, such that the vane assembly divides the chamber into a first chamber provided between the body and the lower portion and a second chamber provided between the body and the upper portion. The vane assembly includes a plurality of blades aligned at a pitch angle relative to an entrance end of the vane assembly. The outlet is provided at the second end and is fluidly connected to the second chamber to allow the fine particles separated from the coarse particles to flow through the outlet after exiting the vane assembly. The reclaim outlet is fluidly connected with the second chamber and a pulverizer to allow the coarse particles separated from the fluid flow after exiting the vane assembly to be directed back to the pulverizer for regrinding.

The lower and upper portions of the housing may be configured having generally cylindrical shapes, where the intermediate portion has a smaller diameter relative to the diameters of the lower and upper portions. The lower portion of the housing may optionally further include a second reclaim outlet, an outer wall, an inner wall, and an intermediate wall provided between the inner and outer walls and separating the first chamber into an inner first chamber and an outer first chamber. The inlet may be provided between the outer wall and the separating wall and is fluidly connected to the outer first chamber, wherein the second reclaim outlet is provided between the inner wall and the separating wall and is fluidly connected with the pulverizer to direct coarse particles back to the pulverizer for regrinding. The above noted arrangements may, individually or in combination, advantageously force the fluid flow to change direction, such as from moving from the inlet to the vane assembly, which may cause coarse particles to separate from the fluid flow prior to passing through the vane assembly (e.g., a pre-classification), such as by colliding with the inner wall of the lower portion, the lower conical portion of the body, and/or the blades or vanes of the vane assembly.

The body may include opposing upper and lower conical (e.g., frusto-conical) portions, wherein the lower frusto-conical portion is provided adjacent to the intermediate portion of the housing with the vane assembly therebetween, such that a spacing between the lower frusto-conical portion and the intermediate portion narrows from an entrance of the vane assembly to an exit of the vane assembly. In other words, the size of the chamber may have a tapered configuration moving from the entrance to the exit of the vane assembly. This may advantageously aid in the separation of coarse and fine particles passing through the vane assembly, such as, for example, by increasing swirl and/or velocity of the fluid flow through the vane assembly.

The reclaim outlet may be provided in a bottom wall of the upper portion of the housing. The second chamber may be fluidly connected to the outlet pipe between the upper frusto-conical portion and an upper wall of the upper portion of the housing.

The outlet pipe may be fluidly connected to a furnace configured to combust the fine particles passing from the outlet pipe to the furnace.

Another embodiment of this application relates to a classifier for separating fine and coarse particles in a fluid flow. The classifier includes a housing, an outlet pipe, an inner casing, a body, and a reclaim outlet. The housing includes a first end, a second opposing end, and an inlet opening provided at the first end to introduce the fluid flow into the classifier. The outlet pipe is provided at the second end and is configured to be fluidly connected to a furnace. The inner casing is provided within the housing and is fluidly connected to the inlet opening, such that a first chamber is provided between an outer surface of the inner casing and an inner surface of the housing. The body is disposed within the housing and includes a streamlined lower portion that is provided within the inner casing, such that a second chamber is provided between an outer surface of the lower portion of the body and an inner surface of the inner casing. The reclaim outlet is provided at the first end and is fluidly connected to the first chamber. The classifier is configured such that coarse particles are directed to the first chamber and out of the reclaim outlet and fine particles are directed out of the outlet pipe.

The inner casing may include a portion having an increasing cross-sectional size when moving in a longitudinal direction from the first end toward the second end. The lower portion of the body may include an increasing cross-sectional size when moving in the longitudinal direction from the first end toward the second end. The lower portion of the body may be provided adjacent to the portion of the inner casing. The lower portion of the body may have a conical shape, and the adjacent portion of the inner casing may have a conical shape. This may advantageously aid in the separation of coarse and fine particles passing through the vane assembly, such as, for example, by increasing swirl and/or velocity of the fluid flow through the vane assembly.

The classifier may optionally further include a vane assembly, such as an annular vane assembly, provided between the conical portion of the body and the conical portion of the inner casing. The vane assembly may include a plurality of blades (e.g., vanes) radially arranged around the vane assembly. Each blade may have an inner end coupled to the conical portion of the body and an outer end coupled to the conical portion of the inner casing, such that each blade has an increasing length between the inner and outer ends when moving from the entrance of the second chamber toward the exit of the second chamber. The classifier may optionally further include a second vane assembly provided in the inlet pipe, wherein the second vane assembly includes a plurality of blades having a radial arrangement.

The classifier may optionally further include an inlet pipe provided at the first end of the housing, wherein the inlet pipe is fluidly connected to the inlet opening of the housing and is configured to receive the fluid flow from a pulverizer.

Yet another embodiment of this application relates to a method for separating fine particles and coarse particles in a fluid flow. The method includes the steps of introducing the fluid flow having fine and coarse particles into an inlet pipe provided at a first end of a housing; directing the fluid flow from the inlet pipe into an inner casing that is fluidly connected to the inlet pipe; directing the fluid flow through a vane assembly that is provided between an inner portion of the inner casing and an outer portion of a streamlined body provided within the inner casing, wherein the vane assembly includes a plurality of vanes having a pitch angle relative to an entrance end of the vane assembly to induce the fluid flow to swirl for the purpose of separating the fine and coarse particles; directing the coarse particles into a chamber between the housing and the inner casing to pass through a reclaim outlet provided at the first end of housing; and directing the fine particles into an outlet pipe provided at a second end of the housing that is opposite the first end.

DETAILED DESCRIPTION

Figure 2:
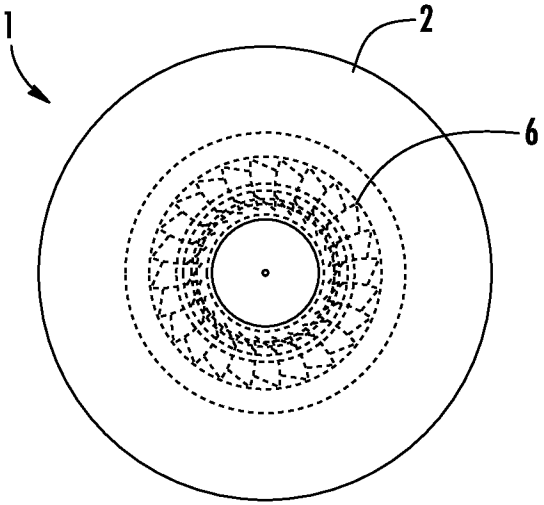
FIG. 2 is a top view of the classifier of FIG. 1.

Pulverized coal has been and continues to be widely used for power generation. A size reduction device, such as a pulverizer, converts raw coal into finer particles known as pulverized coal. In combination with a pulverizer, a classification device is typically deployed for the purposes of separating the relatively coarse particles, which may be reclaimed for regrinding, from the finer particles which are desired for promoting a cleaner burning and higher efficiency downstream combustion process. Since improvements in fineness of pulverized coals result in a more efficient and cleaner burning process, it is desirable to further improve the fineness (of the coals) to reduce emissions and improve the overall energy efficiency in the downstream combustion process.

Accordingly, the classifiers disclosed herein are configured to improve coal classification. Furthermore, the classifiers disclosed herein may also be configured to improve classification of other materials, such as those used in other industries. For example, other mineral processing industries also benefit from improved fineness of particles. One specific example is the cement industry, which has a similar set of challenges, where cement clinker (i.e., lumps or nodules) from upstream calcining operations must be size-reduced via pulverization. Accordingly, cement classifiers are used to separate relatively coarse cement particles, which may be reclaimed for regrinding, from the finer cement particles, which are desired for use in aggregate concrete applications. In general, the finer the cement particle distribution, the higher the strength of the concrete aggregates.

With general reference to the Figures, disclosed herein are classifiers (e.g., static internal, static external) that are configured to improve coarse particle separation from a fluid flow initially comprising fine and coarse particles. For example, the classifiers may reduce the number and mass fraction of coarse particles (e.g., having sizes greater than about 200 micrometers) relative to the total number and mass of particles that exit the classifier through an outlet to be introduced to a downstream process or device (e.g., a furnace). The classifiers may, for example, improve the efficiency of the downstream process or device by introducing a fluid flow comprising particles having a higher number and mass of fine particles (e.g., having sizes less than or equal to about 200 micrometers).

Classifiers may be configured to be external or internal to the particle size reduction equipment (e.g., pulverizer or milling) system. External classifiers may utilize piping or conveyance systems to inlet pulverized particles (e.g., coal particles) from a remotely located pulverizer, then classify (e.g., separate based on a category, such as mass or size) the particles, rejecting and transferring the coarse particles through a pipe back to the pulverizer, and accepting and passing the fine particles through piping or a conveyance system to a downstream process (e.g., burner, furnace, etc.). Internal classifiers typically are constructed together with the pulverizer in-line with the furnace (e.g., burner, boiler), to comprise a single system that pulverizes the raw material (e.g., fuel) then classifies the particles (e.g., fuel particles), passing the fine particles to the downstream process (e.g., burner, furnace, etc.) and rejecting the coarse particles to be further ground within the pulverizer to reduce the particle size. The present application relates to improved classifiers for both internal and external applications that more efficiently classify the coarse and fine particles.

Additionally, classifiers have typically been grouped into two types: static and dynamic. Static classifiers generally involve the use of fluid (e.g., gas) flow to generate centrifugal forces by cyclones or swirling flows to move coarse particles to the peripheral walls of the classifier where a combination of gravitational and centrifugal forces overcomes drag forces, which allows the heavier or larger particles to drop out of the flow and be rejected back to the pulverizer. Dynamic classifiers generally involve the use of rotating classifier blades to generate the centrifugal forces necessary to improve particle classification and physical impact with particles to reject them back to the pulverizer. The present application relates to improved static classifiers that more efficiently classify (e.g., separates) the coarse and fine particles, such as a solid fuel (e.g., coal). Static classifiers may include moving and/or adjustable components, but typically are not equipped with continuously motor driven rotational fan blades or rotational vanes. For example, vane angle or deflector plate locations inside static classifiers may be adjusted during operation of the pulverizer.

Figure 3A:
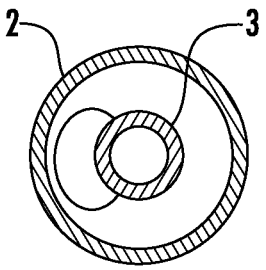
FIG. 3A is a cross-sectional view of the classifier of FIG. 3, taken along line 3A-3A of FIG. 3.
Figure 3:
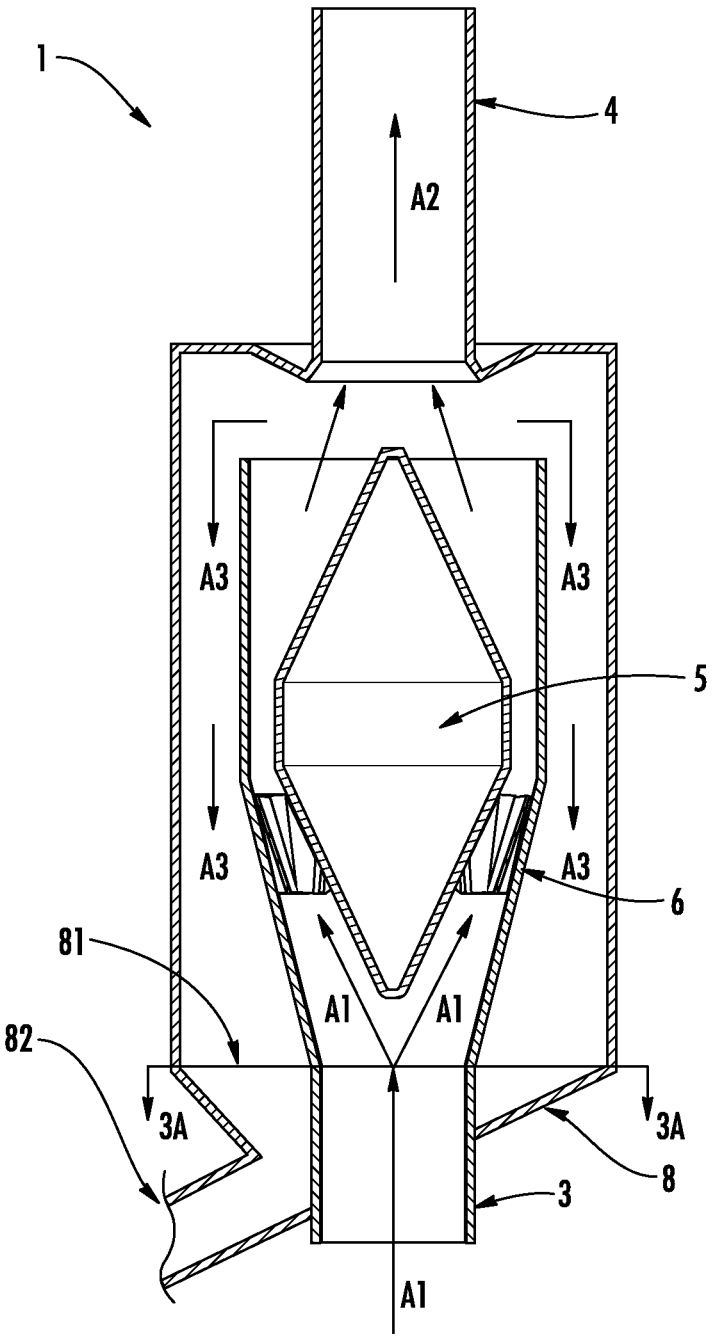
FIG. 3 is a side cross-sectional view of another exemplary embodiment of a classifier.

FIGS. 1-12 illustrate an exemplary embodiment of a classifier 1 that includes a housing 2, an inlet 3, an outlet 4, an inner casing 5, a vane assembly 6 (e.g., baffle), and a body 7 (e.g., a stationary body, a streamlined body, a bluff, a distributor, etc.). The housing 2 may be generally cylindrically shaped and is configured to enclose the classifier. The housing 2 is hollow in order to define one or more inner chambers or cavities, such as in combination with other components (e.g., the inner casing 5), through which the fluid and particle mixture may flow. As shown in FIGS. 4-9, the housing 2 includes an upper hollow cylindrical portion 21 and a lower hollow conical portion 22, where the housing 2 is configured to surround the inner casing 5, the vane assembly 6, and the stationary body 7. Provided between an inner surface of the housing 2 and the outer surface of the inner casing 5 is a first chamber 11 (e.g., a first cavity), which may serve as the separation zone, where the coarse particles are rejected back to the pulverizer for regrinding and the fine particles exit the classifier. As shown in FIG. 3, the housing may include only a cylindrical shape.

Figure 4:
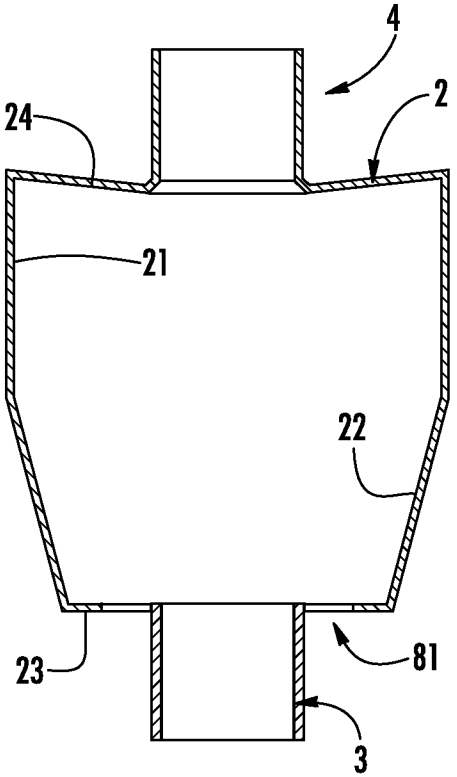

The inlet 3 may be configured to introduce a solid material (e.g., crushed or pulverized coal) into the classifier. For example, the inlet 3 may receive pulverized coal from a pulverizing assembly (not shown) that is configured to receive raw solid material and reduce the size of the particles. As shown in FIG. 4, the inlet 3 is configured as a tube (e.g., a pipe) that is provided at a first end 23 (e.g., a bottom end) of the housing 2. For example, the inlet 3 may be configured as a cylindrical tube having a first end 31 and a second end 32. The first end 31 may be configured to be coupled to the first end 23 of the housing 2, and the second end 32 may be configured to receive the solid material therethrough. It is noted that the inlet 3 may be configured to be coupled to the housing 2 at other locations, and may also be configured having a different geometry (e.g., shape, size, etc.) than what is disclosed in the various examples provided herein.

The outlet 4 may be configured to convey the fluid and particle mixture to a downstream process, such as to a reactor or burner configured to combust the particles of fuel (e.g., coal). As shown in FIG. 4, the outlet 4 is configured as a tube (e.g., a pipe) that is provided at a second end 24 (e.g., a top end) of the housing 2 that opposes the first end 23. For example, the outlet 4 may be configured as a cylindrical tube having a first end 41 and a second end 42, where the first end 41 is configured to be coupled to the housing 2 and the second end 42 is configured to convey the fluid and particle mixture to another component downstream of the classifier 1. It is noted that the outlet 4 may be configured to be coupled to the housing 2 at other locations and may also be configured having a different geometry (e.g., shape, size, etc.) than what is disclosed in the various examples provided herein.

Figure 1:
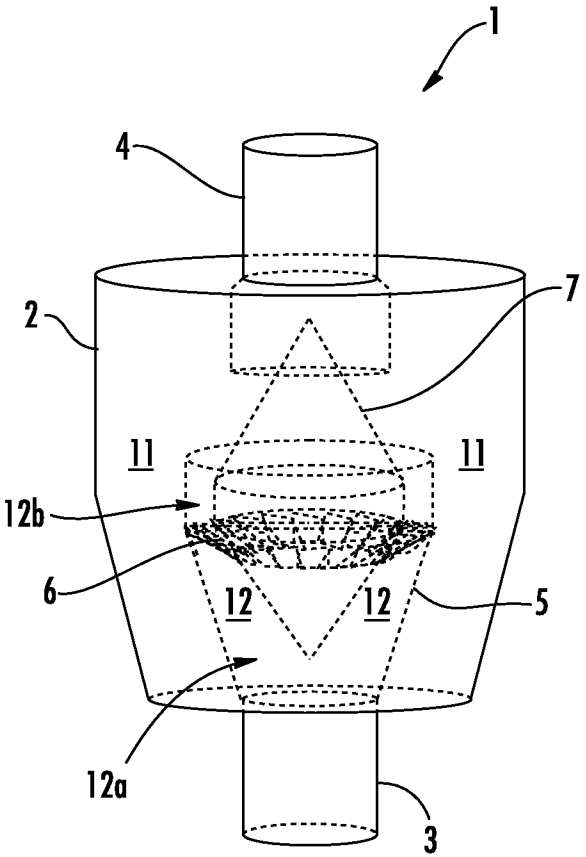
FIG. 1 is a perspective view of an exemplary embodiment of an external classifier.

The inner casing 5 is disposed within the housing 2 and is configured to help control (e.g., influence) the flow of the fluid and particle mixture through the classifier 1. For example, the inner casing 5 may be configured to help guide the fluid and particle flow into the vane assembly 6 of the classifier 1. As shown in FIG. 1, the classifier 1 includes a second chamber 12 (e.g., a second cavity) provided between an inner surface of the inner casing 5 and the stationary body 7, where the second chamber 12 is configured to fluidly connect the inlet 3 and the vane assembly 6, such that the particles entering the classifier 1 through the inlet 3 pass through the second chamber 12 into the vane assembly 6. The first chamber 11 may be located after the vane assembly 6, such as, for example, provided between the housing 2 and the outer surface of the inner casing 5.

Figure 5:
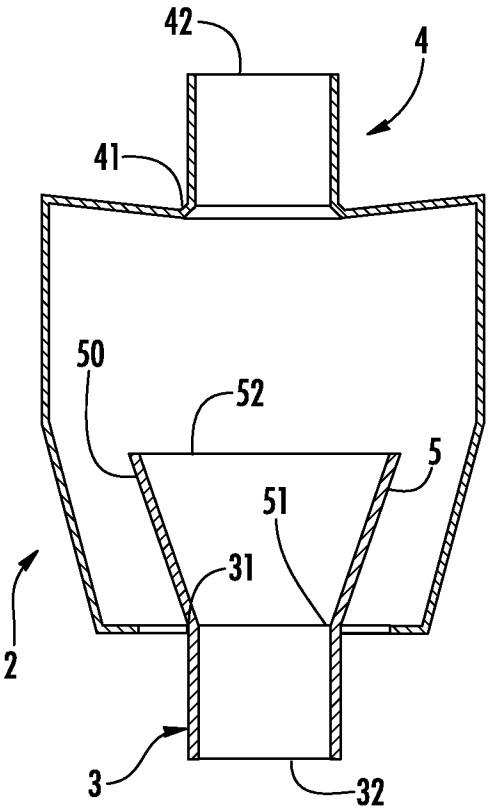

As shown in FIG. 5, the inner casing 5 includes a first portion 50 (e.g., a lower portion) configured having a conical shape (e.g., a frusto-conical shape) with an increasing size (e.g., diameter, cross-sectional area, etc.) moving from a first end 51 (e.g., an inlet end, an entrance end, etc.) toward a second end 52 (an outlet end, an exit end, etc.). The first portion 50 may be configured having other shapes, which may have an increasing size (e.g., cross-sectional size, area, etc.) and/or a generally uniform size when moving in a longitudinal direction from the first end 51 toward the second end 52.

The first end 51 may be configured to be coupled to the inlet 3, such as the first end 31 of the inlet 3, to fluidly connect the inlet 3 and the inner casing 5. The inner casing 5, such as the first end 51, may also be coupled to the housing 2. The second end 52 may be configured to receive or be coupled to the vane assembly 6. The second end 52 may also be configured to be coupled to the stationary body 7, such as to structurally support the stationary body 7 in the classifier 1. As shown, the diameter of the of the first end 51 is smaller relative to the diameter of the second end 52, for example, to accommodate the stationary body 7. In other words, the inner casing 5 may be conical in shape so as to be advantageously tailored to the conical bottom of the stationary body 7. It is noted that the inner casing 5 may be configured to be coupled to the inlet 3 and/or the housing 2 at other locations, and may also be configured having a different geometry (e.g., shape, size, etc.) than what is disclosed in the various examples provided herein. It is also noted that although FIGS. 4 and 5 show the inlet 3 and the inner casing 5 as two separate elements, the inlet 3 and the inner casing 5 may be integrally formed as one unitary component.

Figure 8:
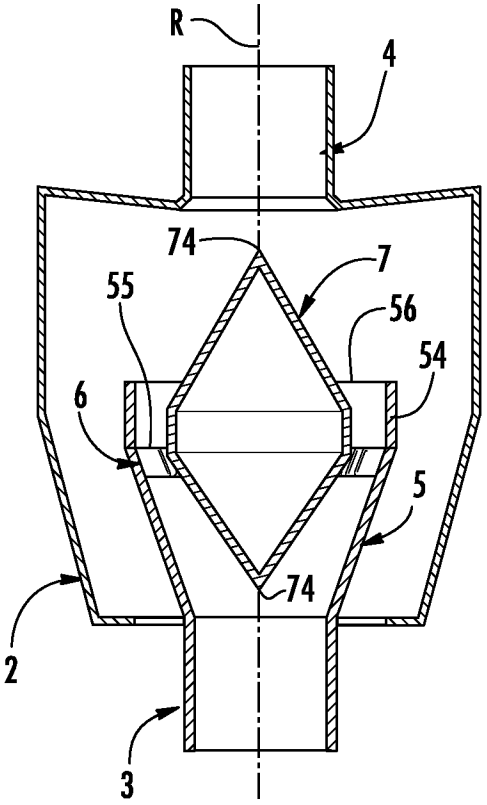

The casing 5 may include an additional portion. As shown in FIG. 8, the inner casing 5 includes a second portion 54 (e.g., an upper portion) that is configured to extend from the first portion 50 (e.g., the conical portion) of the inner casing 5. For example, the upper portion 54 may include a lower end 55 and an upper end 56, where the lower end 55 is configured to extend from the second end 52 of the conical portion of the inner casing 5. The upper portion 54 may extend around the stationary body 7. As shown in FIG. 8, the upper portion 54 has a cylindrical shape that extends around part of the upper conical portion and the cylindrical portion of the stationary body 7.

According to another exemplary embodiment, the body is configured as a movable body. For example, the body may be configured as a rotational body that is configured to freely rotate around an axis of rotation. As shown in FIG. 8, the axis of rotation R extends longitudinally (e.g., in a vertical direction) between ends 74 of the conical portions of the rotational body. The rotational body may be configured to freely rotate due to aerodynamic forces generated by the swirl of air flow through a chamber, such as the second chamber 12, of the classifier.

Figure 7:
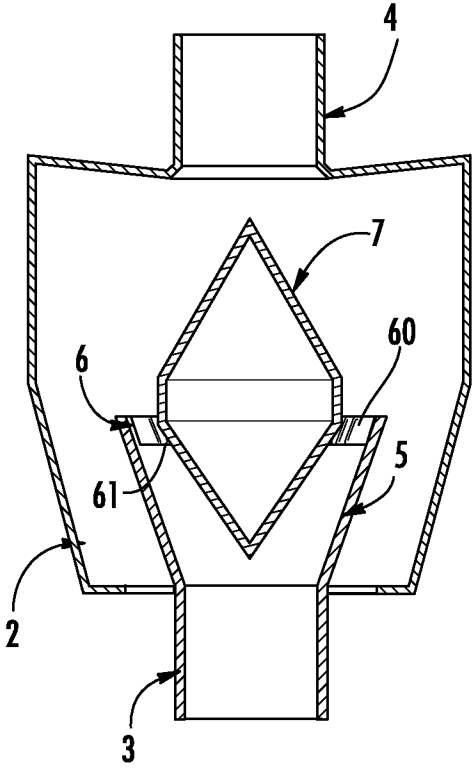

The vane assembly 6 is provided within the housing 2 of the classifier 1, and is configured to influence the flow of the fluid and particle mixture through the classifier 1. As shown in FIG. 1, the vane assembly 6 is provided between the inner casing 5 and the stationary body 7 within the second chamber 12. The vane assembly 6 may be connected to the inner casing 5 and/or the stationary body 7. According to an exemplary embodiment, an inner profile (e.g., surface) of the vane assembly 6 is coupled to the stationary body 7 (e.g., an outer profile or surface thereof), and an outer profile of the vane assembly 6 is coupled to the inner casing 5 (e.g., an inner profile or surface thereof). The height or thickness of the vane assembly 6 may be tailored, such as to tailor the flow of the fluid and particle mixture through the classifier 1. As shown in FIG. 7, the vane assembly 6 includes an entrance 61 (e.g., a base, a bottom surface) and an exit 62 (e.g., an upper surface), where the fluid enters the entrance 61 of the vane assembly 6 and the fluid exits the exit 62. The vane assembly 6 is provided between the inlet 3 and the outlet 4 within the classifier 1. For example, the vane assembly 6 may be provided along a longitudinal axis (which may be co-linear with the axis of rotation R), and may be generally disposed to be concentric to the inlet 3, the stationary body 7, and/or the outlet 4.

Figure 11:
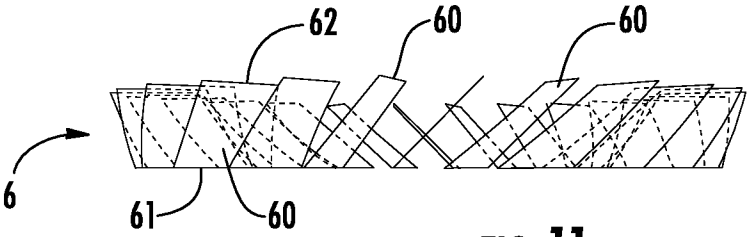
FIG. 11 is a side view of the blades of the vane assembly of FIG. 10.
Figure 12:
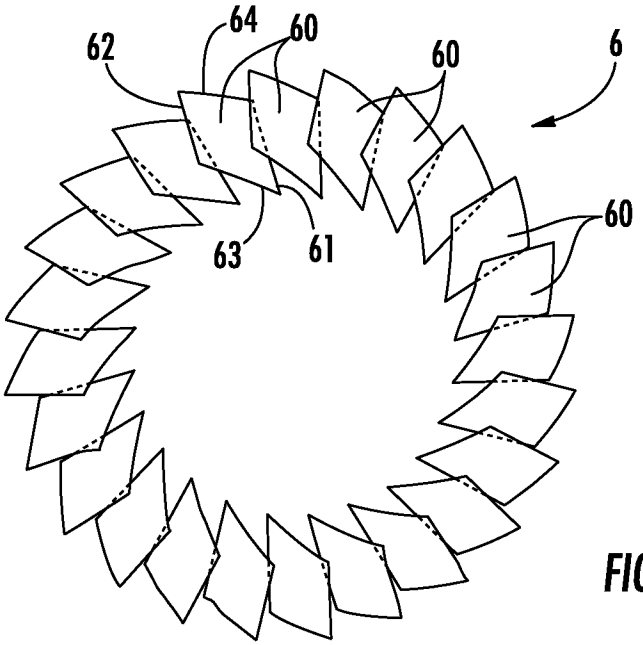
FIG. 12 is a top view of the blades of the vane assembly of FIG. 10.
Figure 10:
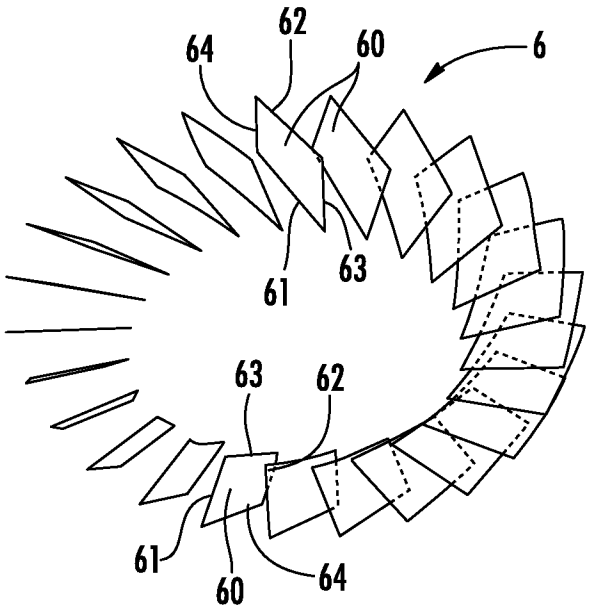
FIG. 10 is a perspective view of blades of an exemplary embodiment of a vane assembly for use with the classifier of FIG. 1.

The vane assembly 6 is configured to include a plurality of blades 60 configured to influence the flow of the fluid and particle mixture through the classifier. As shown in FIGS. 1 and 2, the vane assembly 6 has an annular arrangement configured to be provided between the inner surface of the inner casing 5 and an outer surface of the stationary body 7. The blades 60 may have a radial arrangement or alignment around the annular vane assembly 6. As shown in FIGS. 10-12, the vane assembly 6 may include 24 blades 60 aligned at substantially similar offset distances around the outer diameter of the stationary body 7 and the inner diameter of the inner casing 5. However, the vane assembly 6 may include any number of blades, which may be aligned at similar or uniquely offsetting distances. The blades 60 of vane assembly 6 may be angled at a pitch angle relative to horizontal and/or to the plane defined by the entrance 61 (e.g., the base) of the vane assembly 6. According to an exemplary embodiment, the pitch angle may be between approximately thirty-five (35) and forty-five (45) degrees, such as, for example, substantially equal to forty degrees (40°). According to other embodiments, the pitch angle may be any angle that is greater than zero degrees (0°) and less than ninety degrees (90°).

As shown in FIGS. 10-12, the blades 60 of the vane assembly 6 of the classifier 1 may be configured in a radial alignment (e.g., clockwise alignment) to produce an axial clockwise flow direction of the fluid flow exiting the vane assembly 6 around the stationary body 7. However, the classifier 1 may include a vane assembly that includes a plurality of blades that are configured in a radial alignment (e.g., counter-clockwise) to produce an axial counter-clockwise flow direction of the fluid flow exiting the vane assembly 6 around the stationary body 7.

According to an exemplary embodiment, each blade 60 may be curved, such as, for example, along an inner surface 63 to be configured to match the shape or profile of the stationary body 7. For example, the outer surface of the stationary body 7 may be annular or parabolic-conical shaped, where the inner surface of each blade 60 has a mating shape. The curved inner surface 63 of each blade 60 may be configured to abut the outside convex/concave surface of the stationary body 7. For example, each blade 60 may be configured so there is no gap between the blade and stationary body 7, and the blade 60 may be coupled to the stationary body 7. According to another exemplary embodiment, each blade 60 may include an angled inner surface that is configured to match the shape of the outer surface of the stationary body 7, such as where the stationary body 7 is linearly-conical shaped. According to other exemplary embodiments, the inner surface of each blade 60 may have other suitable shapes.

Also shown in FIGS. 10-12, each blade 60 of the vane assembly 6 may be configured to include a curved outer surface 64 to match the shape or profile of the inner surface of the inner casing 5. Alternative embodiments of the outer surfaces of the blades may be linear shaped or have other suitable shapes that may match the profile of the inner casing 5.

Figure 18:
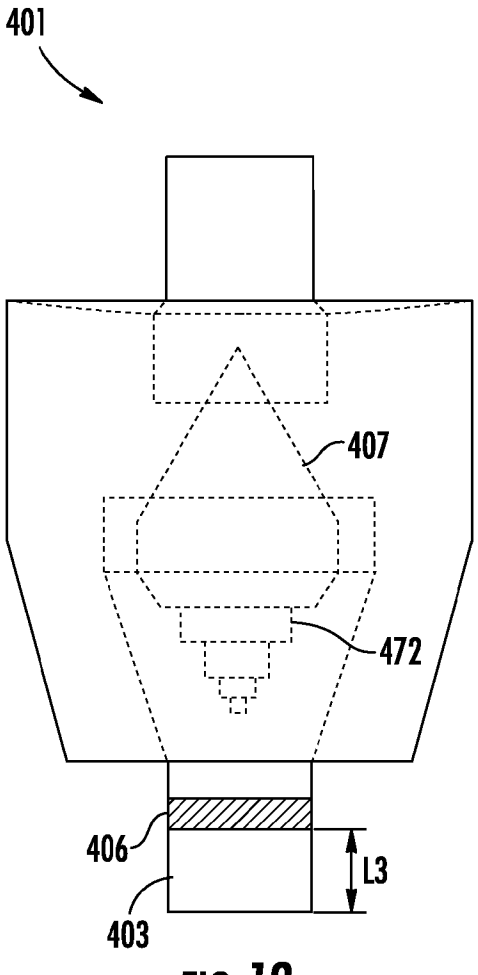
FIG. 18 is a side view of another exemplary embodiment of a classifier.

According to another exemplary embodiment, as shown in FIG. 18, the classifier (referred to as classifier 401 in this embodiment) includes a vane assembly 406. The vane assembly 406 is provided (e.g., disposed) in the inlet 403 to the classifier 401. The vane assembly 406 may be generally cylindrical in shape in order to fit within the cylindrical inlet 403, or may have another suitable shape that is configured to be tailored to the size and shape of the inlet 403, such as the inside surface of the inlet 403. The vane assembly 406 may include a plurality of vanes or blades that are arranged around an axis, such as, for example a central axis (e.g., a longitudinal axis). The position of the vane assembly 406 within the inlet 403 may be tailored. For example, the vertical position of the vane assembly 406 relative to a bottom surface, measured as length L3 in FIG. 18, may be changed for different embodiments.

Figure 6:
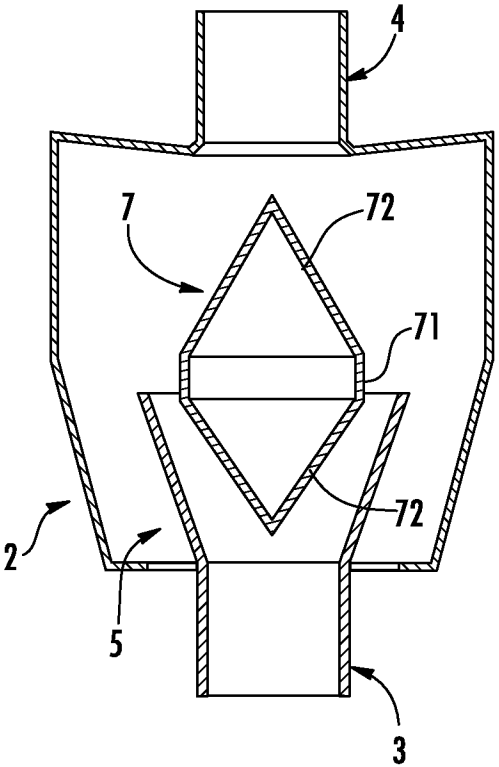
FIGS. 4-9 are various side cross-sectional views of the classifier of FIG. 1 at various states of assembly.

The stationary body 7 is disposed within the housing 2 and is configured to help control (e.g., influence) the flow of the fluid and particle mixture through the classifier 1. As shown in FIG. 6, the stationary body 7 is also provided in the inner casing 5, such that stationary body 7 and the inner casing 5 define the second chamber 12 through which the fluid and particle mixture flows. The shape of the stationary body 7 may be tailored to tailor the flow in the classifier 1. As shown, the stationary body 7 includes a cylindrical portion 71 and opposing conical portions 72, where each conical portion 72 extends away from an end of the cylindrical portion 71. Moreover, each conical portion 72 may extend away from the cylindrical portion 71 in a converging manner. It is noted that the aspect ratio (e.g., the length over the diameter of each conical portion and the stationary body 7 itself) may be tailored to tailor the fluid flow through the classifier 1. The shapes of the stationary body 7 and the inner casing 5 define the shape of the second chamber 12 provided therebetween. For example, the lower conical portion of the stationary body 7 and the conical portion of the inner casing 5 may define a first portion 12*a* of the second chamber 12 that has a narrowing shape (e.g., cross-sectional area) moving in a direction from the first end 51 toward the second end 52. This narrowing shape of the first portion 12*a* of the second chamber 12 may advantageously influence the fluid flow, such as by increasing its velocity. Also, for example, the second chamber 12 may include a second portion 12*b* provided between the cylindrical portion 71 of the stationary body 7 and the upper portion 54 of the inner casing 5 (which may have a cylindrical shape).

The stationary body 7 may include a generally smooth exterior surface, a non-smooth exterior surface, or a combination thereof. For example, one (or more) of the conical surfaces 72 may include an exterior surface that is configured having a shape that is not smooth in order to influence the flow of the fluid and particle mixture through the classifier. As a more specific example, the lower conical portion 72 may be configured having a stepped arrangement with a plurality of stepped annular sections. The plurality of stepped annular sections may have different diameters, such as, having decreasing diameters (from top to bottom) that together form a generally conical shape. As shown in FIG. 18, the classifier 401 includes a lower portion 472 of the body 407 having a plurality of generally cylindrical stepped sections, where each lower section has a smaller diameter compared to the section above it. The stepped arrangement may introduce a roughness to the lower portion of the stationary body, which may act to redistribute any particles accumulated along the exterior (e.g., exterior wall) of the stationary body back into the main conveying flow.

Figure 9:
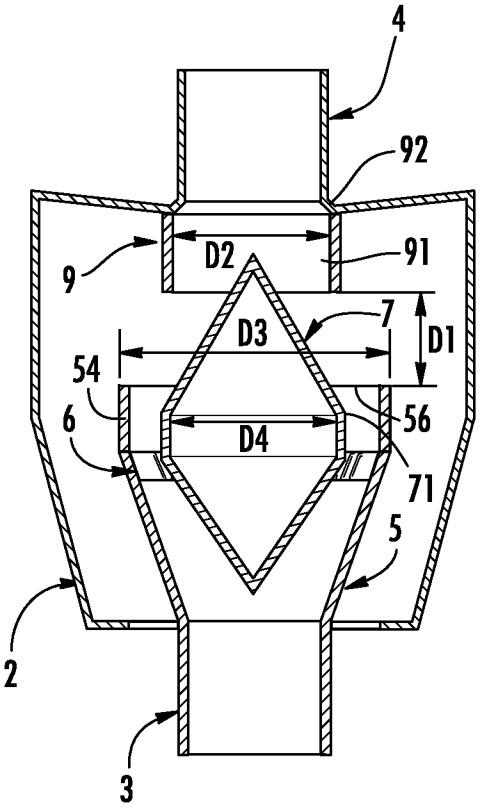

As shown in FIG. 9, the dimension D1 (e.g., distance, length, etc.) corresponds to the distance between the upper end 56 of the inner casing 5 and a bottom of the annular portion 91 of the hood 9, the dimension D2 (e.g., distance, length, diameter, etc.) corresponds to the diameter of annular portion 91, the dimension D3 corresponds to the diameter of the upper portion 54, and the dimension D4 corresponds to the diameter of the cylindrical portion 71 of the stationary body 7. The dimensions of the classifier (e.g., dimension D1, D2, D3, D4) may influence the flow of the fluid and particle mixture through the classifier 1. Moreover, the relationship between two or more dimensions may also influence the flow of the fluid and particle mixture through the classifier 1. For example, the ratio D1/D2, the ratio D1/D3, the ratio D1/D4, the ratio D2/D3, the ratio D2/D4, and/or the ratio D3/D4 may influence the fluid and particle flow.

Figures 15, 16, 17:
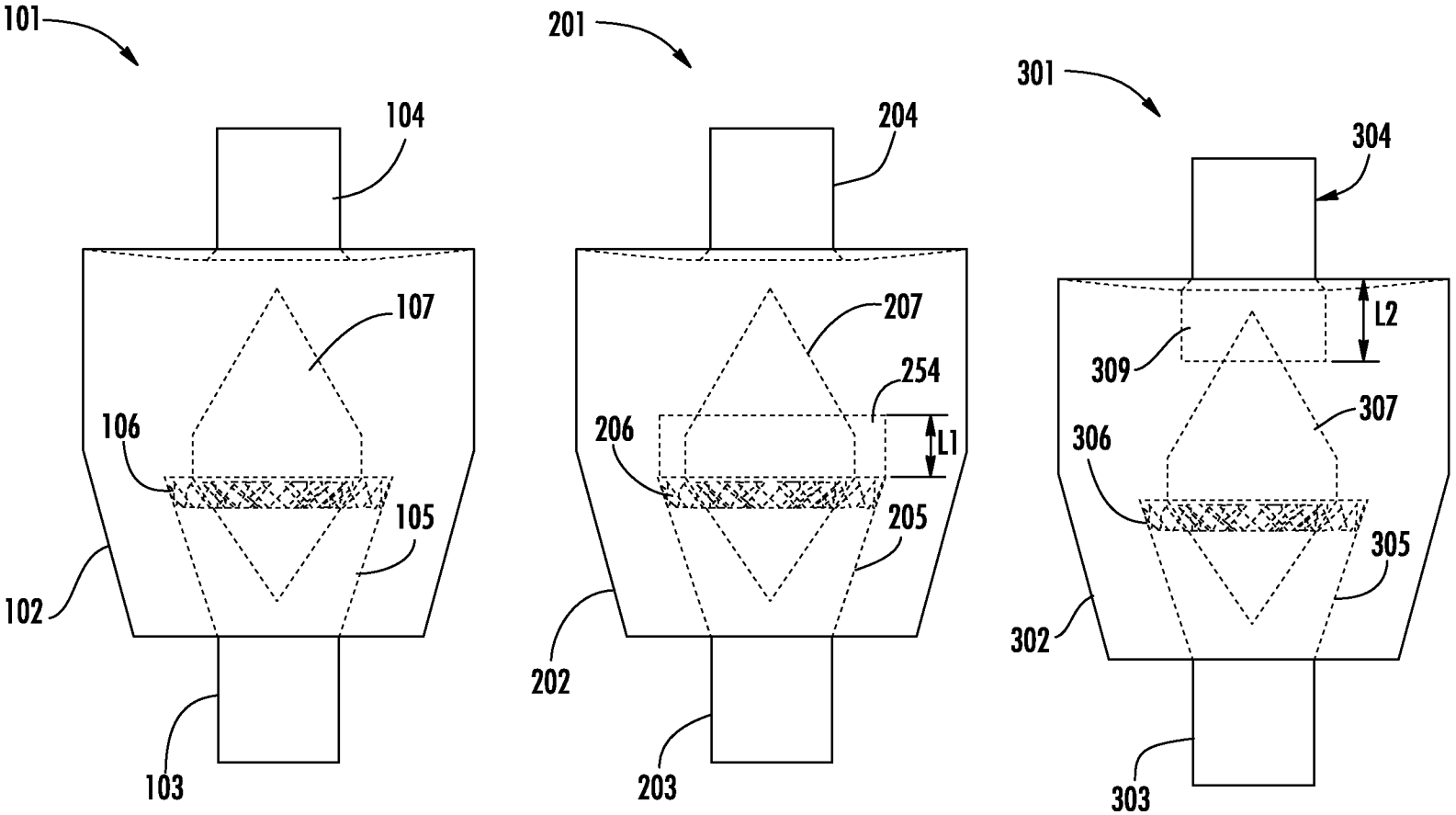
FIG. 15 is a side view of another exemplary embodiment of a classifier.
FIG. 16 is a side view of another exemplary embodiment of a classifier.
FIG. 17 is a side view of another exemplary embodiment of a classifier.
Figure 19:
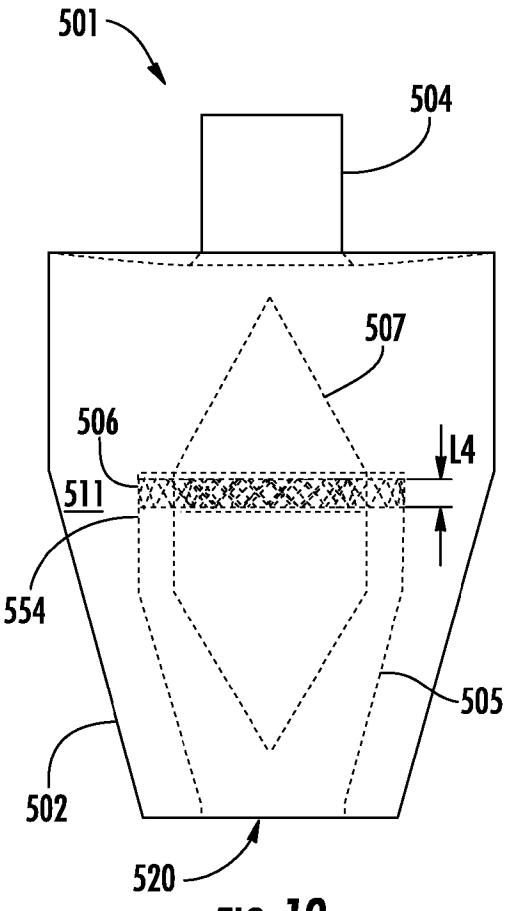
FIG. 19 is a side view of another exemplary embodiment of a classifier.

The classifier may also include other dimensions that may influence the flow of particles and fluid through the classifier. For example, as shown in FIG. 16, the length L1 (e.g., height) of the upper portion 254 of the inner casing 205 may be tailored to influence the flow. Also, for example, as shown in FIG. 17, the length L2 of the hood 309 may be tailored to influence the flow. As yet another example, as shown in FIG. 19, the length L4 of the vane assembly 506 may be tailored to influence the flow through the classifier.

The classifier 1 may also include a second outlet 8 that is configured to reclaim the separated particles (e.g., the coarse particles) from the fluid flow. As shown in FIGS. 3 and 4, the second outlet 8 (e.g., reclaim outlet) is provided at the first end 23 of the housing 2 and adjacent to the inlet 3. For example, the second outlet 8 may be provided in the first end 23 and have a generally concentric and annular arrangement around the first end 31 of the inlet 3. The second outlet 8 may include one opening or a plurality of openings in the first end 23. The second outlet 8 may be fluidly connected to, for example, a pulverizer (e.g., the pulverizer 790 shown in FIG. 33) to regrind the captured coarse particles to then be re-circulated back through the classifier 1. The second outlet 8 may be provided at the bottom of the classifier 1 to advantageously utilize gravity in reclaiming coarse particles separated from the fine particles in the fluid flow. The arrangement of having the reclaim outlet and the inlet to the classifier at the same end is advantageous, and in particular, for the classifier integrated with a pulverizer, since having the reclaim outlet and the inlet fluidly connected to the pulverizer on the same side provide a more compact system and simplified flow path for the fluid and particles contained therein. It is noted that the second outlet may be provided at other locations of the classifier and may be configured differently than disclosed herein.

The classifier may also include a hood 9 disposed on an end of the outlet 4. As shown in FIG. 9, the hood 9 includes an annular portion 91 or member (e.g., having a cylindrical shape) that extends away from the outlet 4 in a generally concentric manner. For example, the hood 9 may extend inwardly into the classifier from the first end 41 of the outlet 4 toward the stationary body 7. The annular hood 9 may extend downwardly in the longitudinal direction to overlap with a portion of the stationary body 7, such as the upper conical portion 72. The overlapping hood may advantageously direct the fine particles and fluid flow into the outlet 4. The size (e.g., the diameter, length, etc.) of the hood 9 may be tailored to the classifier 1. For example, the length of the hood 9 may be tailored to the aspect ratio of the stationary body 7. The hood 9 may also be integrally formed with, or may be formed separately then coupled to, the outlet 4.

The hood 9 may be configured to be larger than the outlet 4. For example, the diameter of the annular portion 91 of the hood 9 may be larger relative to the diameter of the first end 41 of the outlet 4. This arrangement may advantageously accommodate for the size of the stationary body 7 and/or may influence (e.g., increase) the velocity of the fluid carrying the fine particles through the outlet 4. Accordingly, the hood 9 may include a lead-in portion, such as a conical portion 92 that connects the annular portion 91 to the outlet 4. The size of the conical portion 92 may be tailored to, for example, the size of the outlet 4 and the hood 9.

FIG. 3 illustrates the flow of the fluid and particle mixture through the classifier 1. The arrows A1 show the flow of the inlet fluid and particle mixture (e.g., comprising both fine and coarse particles). The inlet fluid A1 enters the classifier 1, such as, for example, from a pulverizer, through the inlet 3 and passes through the second chamber 12 and into the vane assembly 6. The arrow A2 represents the classified fluid and particle mixture (e.g., comprising the fine particles). The arrows A3 represent the reclaimed fluid and particle mixture (e.g., comprising the coarse particles).

The vane assembly 6 in combination with the generally V-shaped second chamber 12 (e.g., defined by the stationary body 7 and the inner casing 5) induce swirl and direct the coarse particles in the fluid flow outward to a dead zone within the chamber. For example, the coarse particles may be directed to a portion of the first chamber 11 that is outside (e.g., in a radial direction from the longitudinal axis toward the outside of the housing) of the vane assembly and/or the casing to allow the coarse particles to fall down to the reclaim outlet. Additionally, the shape of the stationary body 7 (e.g., the opposing conical portions) induces a relatively quick change in direction. The dead zone in combination with the change in direction may provide improved classification by preventing the separated coarse particles from becoming re-entrained into the main upward flow of the fine particles exiting the outlet 4.

Figure 13:
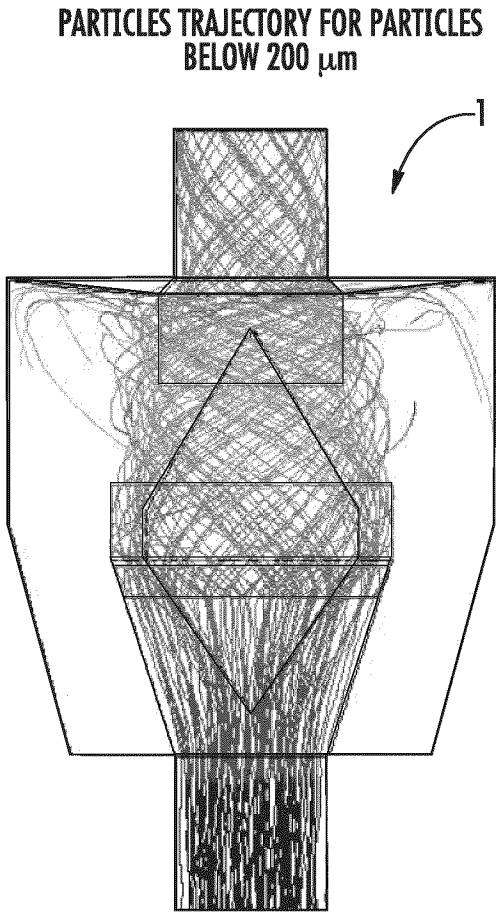
FIGS. 13 and 14 are cross-sectional views showing computer generated analysis of the particle trajectories for particles having the specified sizes.
Figure 14:
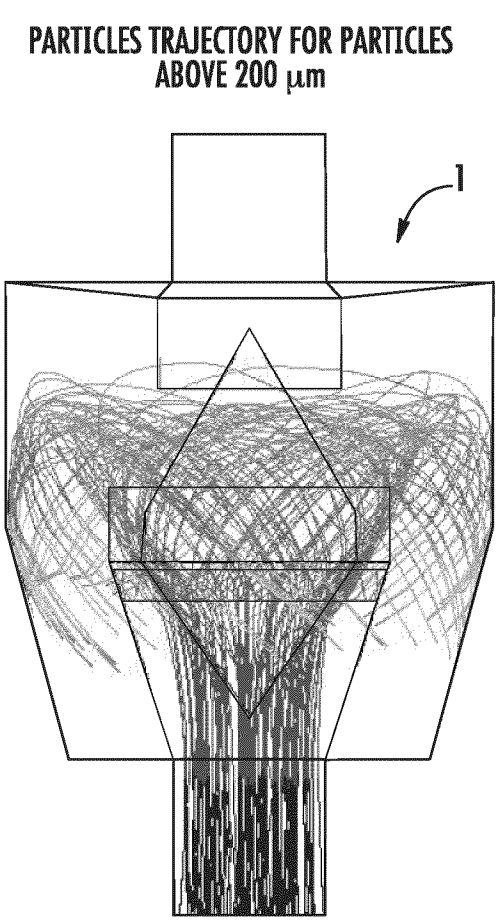

FIGS. 13 and 14 illustrate the results of computer generated models using Computational Fluid Dynamics (CFD) analyzing the particle trajectories for particles through a classifier modeled to represent the classifier 1. FIG. 13 shows the predicted results of the trajectories of particles having sizes below 200 micrometers, and FIG. 14 shows the predicted results of the trajectories of particles having sizes greater than 200 micrometers. As shown in FIG. 13, substantially all of the particles having sizes less than 200 micrometers are allowed to pass through the outlet 4 of the classifier 1 (and onto the downstream process, such as to be combusted). As shown in FIG. 14, substantially all of the particles having sizes greater than 200 micrometers are separated from the fluid flow and reclaimed through a second outlet (e.g., the second outlet 8, if provided) of the classifier 1 (and sent to the pulverizer for regrinding).

FIGS. 15-20 illustrate additional exemplary embodiments of external classifiers. The classifier 101 shown in FIG. 15 is configured generally the same as the classifier 1, except it does not include the hood (i.e., the hood 9 shown in FIG. 9) and does not include an upper portion on an inner casing 105 (i.e., the upper portion 54 shown in FIG. 8). Thus, the classifier 101 includes a housing 102, an inlet 103, an outlet 104, the inner casing 105, a vane assembly 106, and a stationary body 107, where each component may be configured generally as provided above for the classifier 1, except the lack of an upper portion on the inner casing 105 and the hood. The vane assembly 106 is provided at the top of the inner casing 105 between the inner casing 105 and the stationary body 107.

The classifier 201 shown in FIG. 16 is configured generally the same as the classifier 1, except it does not include the hood (i.e., the hood 9 shown in FIG. 9). Thus, the classifier 201 includes a housing 202, an inlet 203, an outlet 204, the inner casing 205, a vane assembly 206, and a stationary body 207, where each component may be configured generally as provided above for the classifier 1.

The classifier 301 shown in FIG. 17 is configured generally the same as the classifier 1, except it does not include an upper portion on an inner casing 305 (i.e., the upper portion 54 shown in FIG. 8). Thus, the classifier 301 includes a housing 302, an inlet 303, an outlet 304, the inner casing 305, a vane assembly 306, a stationary body 307, and a hood 309, where each component may be configured generally as provided above for the classifier 1, except the lack of an upper portion on the inner casing 305.

The classifier 401 shown in FIG. 18 is configured generally the same as the classifier 1, except it includes a vane assembly 406 provided in the inlet 403 instead of in the inner casing, and the lower portion 472 of its body 407 includes a plurality of cylindrical portions, as discussed above. However, it is noted that the classifier could include more than one vane assembly, such as a first vane assembly as shown in FIG. 18 and a vane assembly as shown in FIG. 7, or another embodiment provided herein.

The classifier 501 shown in FIG. 19 is configured generally the same as the classifier 1, except it does not include a hood (i.e., the hood 9 shown in FIG. 9) or an inlet pipe (i.e., the inlet 3 shown in FIG. 7), and the vane assembly 506 is provided at the top of the upper portion 554 on an inner casing 505. Thus, the classifier 501 includes a housing 502 having an inlet opening 520, an outlet 504, the inner casing 505, a vane assembly 506, and a stationary body 507, where each component may be configured generally as provided above for the classifier 1. The vane assembly 506 is provided in the upper portion 554, and therefore the fluid flow may exit the vane assembly 506 with the coarse particles turning directly into the first chamber 511 and/or flung to the outer walls of the housing 502 via swirl to be reclaimed, while the fine particles may continue upwardly to the outlet 504.

Figure 20:
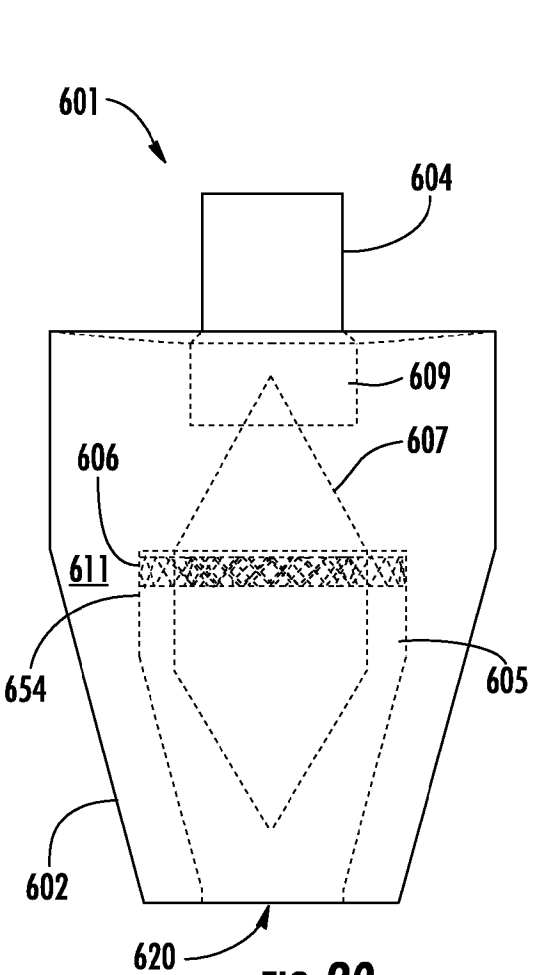
FIG. 20 is a side view of another exemplary embodiment of a classifier.

The classifier 601 shown in FIG. 20 is configured generally the same as the classifier 1, except it does not include an inlet pipe (i.e., the inlet 3 shown in FIG. 7), and the vane assembly 606 is provided at the top of the upper portion 654 on an inner casing 605 instead of below the second end of the casing. Thus, the classifier 601 includes a housing 602 having an inlet opening 620 in the bottom thereof, an outlet 604, the inner casing 605, a vane assembly 606, a stationary body 607, and a hood 609, where each component may be configured generally as provided above for the classifier 1. The vane assembly 606 is provided in the upper portion 654, and therefore the fluid flow may exit the vane assembly 606 such that the coarse particles may turn directly into the first chamber 611 to be reclaimed and the fine particles may continue upwardly to the outlet 604.

As discussed above, in addition to external classifiers, classifiers configured to improve coal classification may be configured as internal classifiers. Internal classifiers typically are constructed together with a pulverizer and a furnace (e.g., burner, boiler), to comprise a single system that pulverizes the raw material (e.g., fuel) then classifies the particles (e.g., fuel particles), passing the fine particles to the downstream process (e.g., burner, furnace, etc.) and rejecting the coarse particles to be further ground within the pulverizer to reduce the particle size. For example, internal classifier may be provided in-line between the pulverizer and the furnace. Several examples of internal classifiers will now be described. Moreover, although the classifiers disclosed above have been described as external classifiers, it is noted that these classifiers may be integrated with a pulverizer and/or other devices (e.g., a furnace, a boiler, a burner) to provide internal classifier systems.

Figure 33:
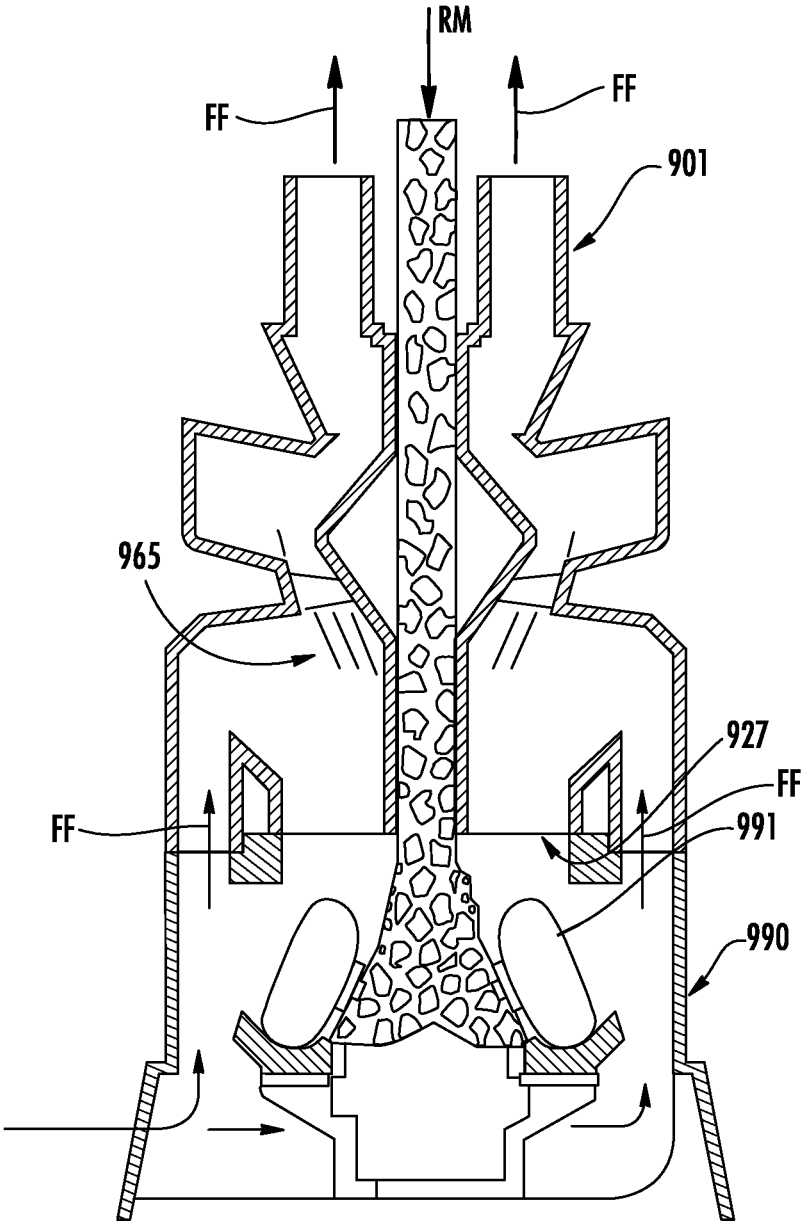
FIG. 33 is a cross-sectional view of the classifier of FIG. 28 with a pulverizer disposed below and operatively coupled to the classifier.

FIG. 33 illustrates an exemplary embodiment of an internal classifier 901 that is operatively coupled to a pulverizer 990 configured to pulverize a raw material through one or more pulverizing devices 991 (e.g., rollers). As shown, the classifier 901 is configured to receive a raw material RM and output the raw material RM into the pulverizer 990 where one or more pulverizing devices 991 reduce the particle size of the raw material. The ground material is then introduced into the classifier through an inlet in a fluid flow FF. The classifier separates the particles based on their configuration, such as the size of the particles, passing coarse particles back to the pulverizer to be reground and passing fine particles to the downstream process.

FIGS. 21-28 illustrate an exemplary embodiment of a classifier 701 (e.g., an internal classifier) that includes a housing 702 having an inlet opening 720 (e.g., an inlet), an outlet 704, a vane assembly 706 (e.g., baffle), and a stationary body 707 (e.g., a streamlined body, a bluff, a distributor, etc.). The housing 702 may include one or more generally cylindrical portions and is configured to enclose other elements or components of the classifier 701. The housing 702 is hollow in order to define one or more inner cavities or chambers, such as in combination with other components (e.g., the stationary body 707), through which the fluid and particle mixture may flow through.

Figure 28:
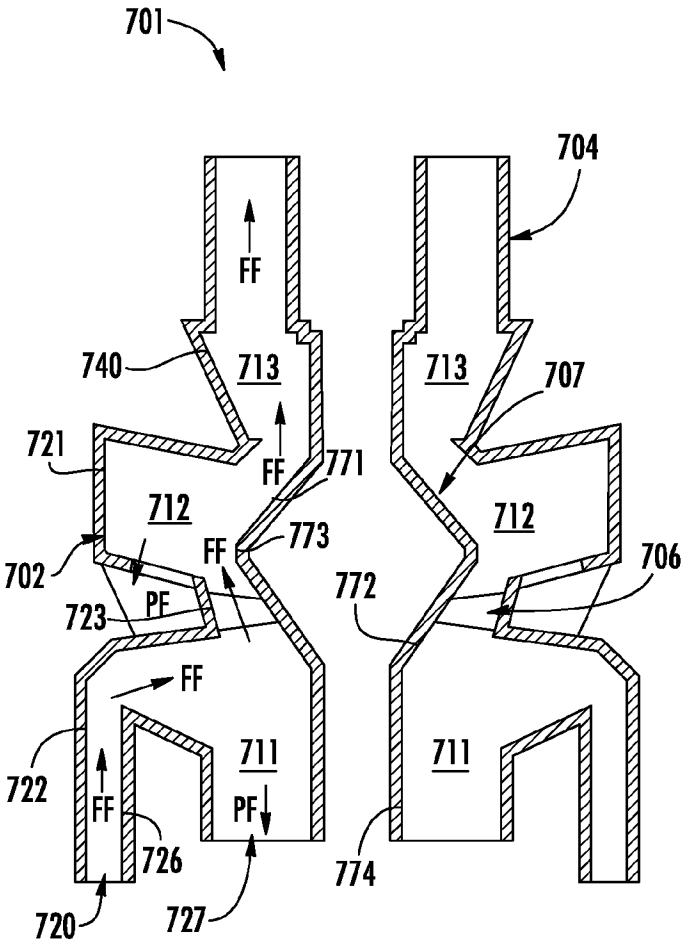
FIG. 28 is a side cross-sectional view of the classifier of FIG. 21.

As shown in FIG. 28, the housing 702 includes an upper cylindrical portion 721 (e.g., a first portion), a lower cylindrical portion 722 (e.g., a second portion), and a central cylindrical portion 723 (e.g., a third portion, an intermediate portion) provided between the upper and lower cylindrical portions. However, the housing 702 may be configured having a different number of portions and the various portions may be configured having other suitable shapes. For example, the lower portion 722 may be separately formed and coupled to the housing 702. Together, the first, second, and third portions 721, 722, 723 of the housing 702 may be configured to surround the vane assembly 706 and the stationary body 707. The central portion 723 may have a smaller size (e.g., diameter) relative to the sizes of the upper and/or lower portions 721, 722, such as to retain the vane assembly 706 between the housing 702 and the stationary body 707 and to thereby create at least one directional change (e.g., a sharp or abrupt directional change) for the fluid and particle mixture flowing through the classifier. This arrangement may advantageously help separate the coarse and fine particles.

The classifier 701 may include an inlet configured to introduce a solid material (e.g., crushed or pulverized coal) into the classifier 701. As shown, the classifier 701 includes an inlet opening 720 provided in the housing 702, such as in the bottom of the housing, to introduce solid material into the classifier. The inlet opening may be provided at an outer portion of the bottom of the housing 702, or may be provided at a central portion of the bottom of the housing 702. As shown in FIG. 28 the inlet opening 720 represents the outer-bottom arrangement, where a wall 726 is provided between inner and outer walls of the lower portion 722 to define the inlet opening 720 (and, according to an exemplary embodiment, the second reclaim outlet opening 727 as well). However, the inlet opening may be configured to have an alternative arrangement, such as a central-bottom arrangement. It is noted that the location of the inlet opening 720 may be provided elsewhere in the housing 702.

Figure 21:
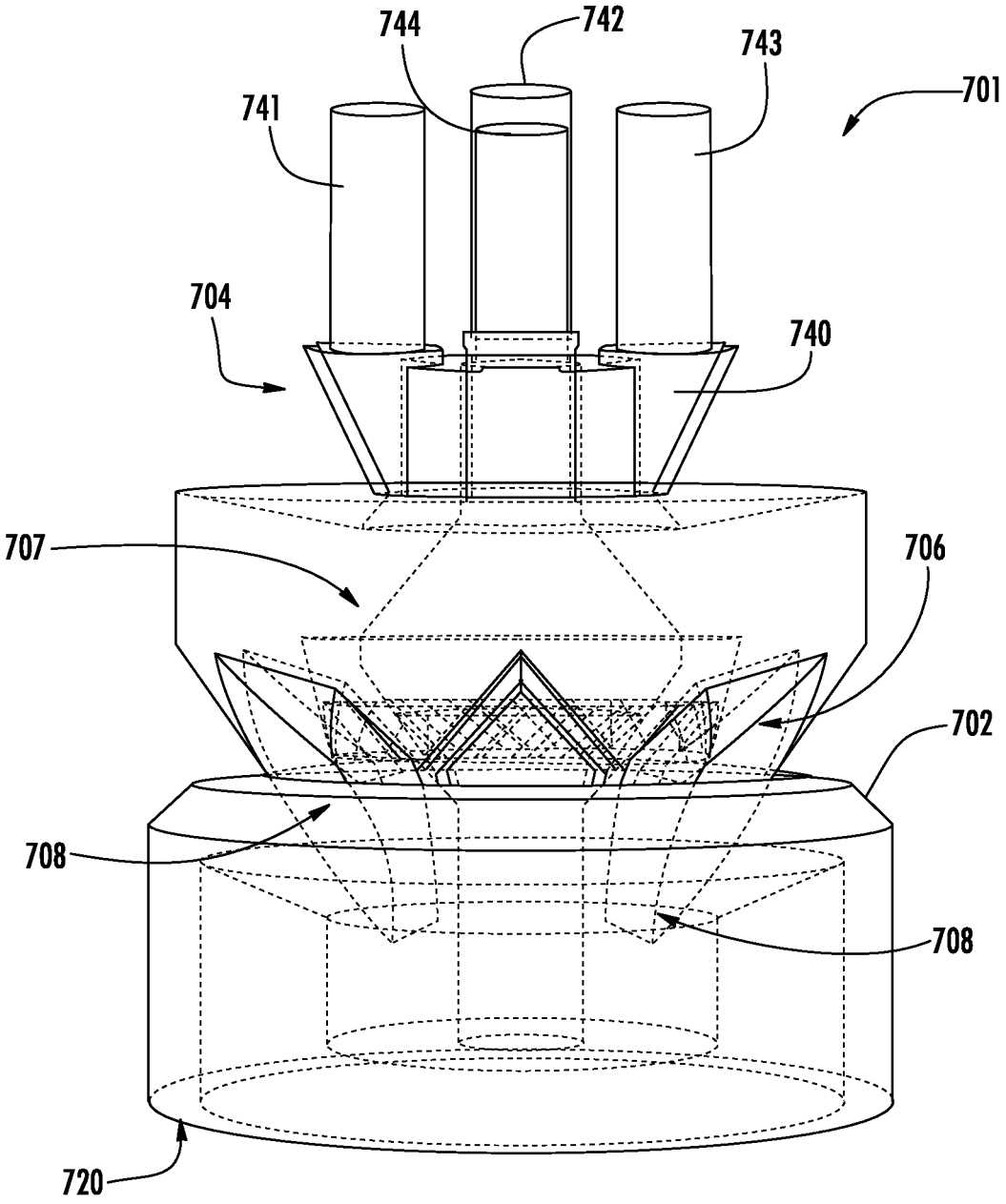
FIG. 21 is a perspective view of an exemplary embodiment of an internal classifier.

The outlet 704 may be configured to convey the fluid and particle mixture to a downstream process (e.g., a furnace, a reactor, a burner). The outlet 704 may include one or more than one pipe (e.g., tube), where each pipe is configured to convey a portion of the classified fluid (e.g., comprising the fine particles) to a common reactor or a plurality of separate reactors. As shown in FIG. 21, the outlet 704 includes a base 740 and four pipes 741, 742, 743, 744 that extend upwardly from the base 740. The pipes 741, 742, 743, 744 may be similarly configured or configured differently (relative to each other) and may be spaced apart evenly or unevenly around the base 740. For example, each pipe may have a substantially similar diameter, such as to convey classified fluid to four separate reactors having generally common configurations. Also, for example, the pipes 741, 742, 743, 744 may have different diameters relative to one another, such as to convey classified fluid to four separate reactors having different configurations. Thus, the outlet 704 may be tailored to the downstream process(es) or device(s) configured to receive the classified fluid from the classifier 701.

Figure 22:
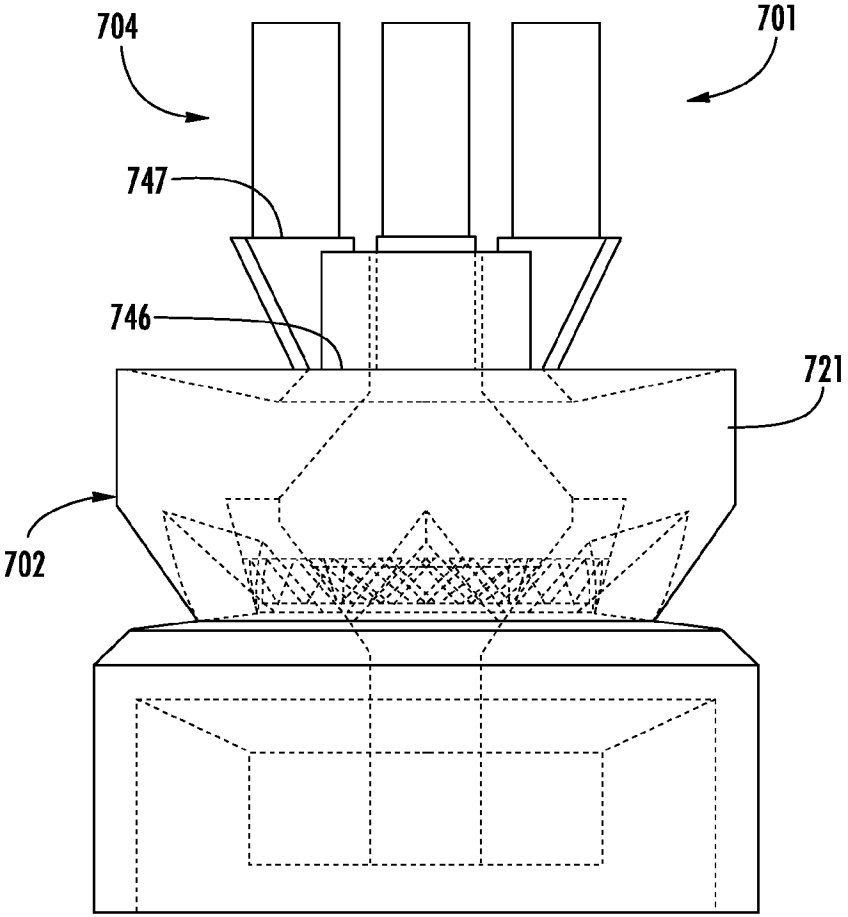
FIG. 22 is a side view of the classifier of FIG. 21.

The base 740 of the outlet 704 may be configured to be coupled to the housing 702. For example, the base 740 may include a lower end 746 that is configured to mount or be coupled to an upper surface of the first portion 721 of the housing 702, as shown in FIG. 22. The base 740 may also be configured to be coupled to one or more than one pipe (e.g., the pipes 741, 742, 743, 744). For example, the base 740 may include an upper end 747 that is configured to mount or be coupled to a lower end of each pipe or tube, also shown in FIG. 22.

The vane assembly 706 is configured to influence the flow of the fluid and particle mixture through the classifier 701 such as by swirling the fluid flow. The vane assembly 706 may be configured generally as provided above for one of the vane assemblies (e.g., the vane assembly 6), or may be configured differently than the other vane assemblies. The vane assembly 706 may be provided between the housing 702 and the stationary body 707. For example, the vane assembly 706 may be provided between the third portion 723 of the housing 702 and the stationary body 707 to direct the fine particles from the fluid and particle mixture toward the outlet 704 and to direct the coarse particles from the fluid and particle mixture toward the reclamation zone. The vane assembly 706 may help provide pre-classification (e.g., by knocking relatively coarse particles from the fluid flow with the blades prior to passing completely through the vane assembly) and post-classification (e.g., by causing the fluid flow to swirl after exiting the vane assembly 706 to direct coarse particles outward toward the housing, while allowing the fine particles to pass to the outlet).

Figure 25:
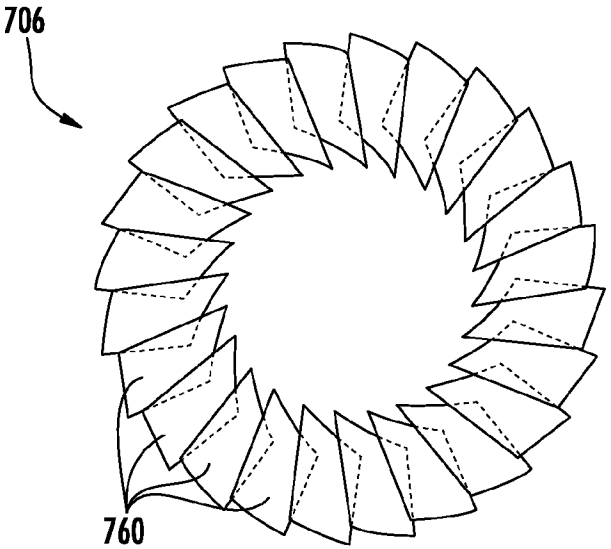
FIG. 25 is a top view of the vanes of FIG. 24.
Figure 26:
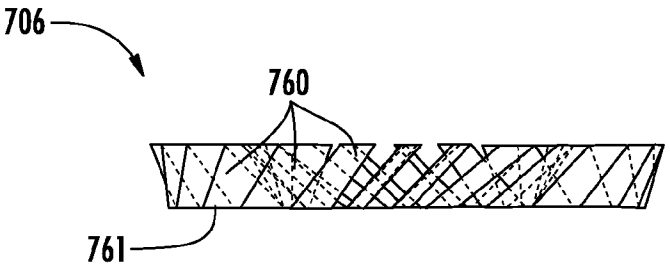
FIG. 26 is a side view of the vanes of FIG. 24.
Figure 24:
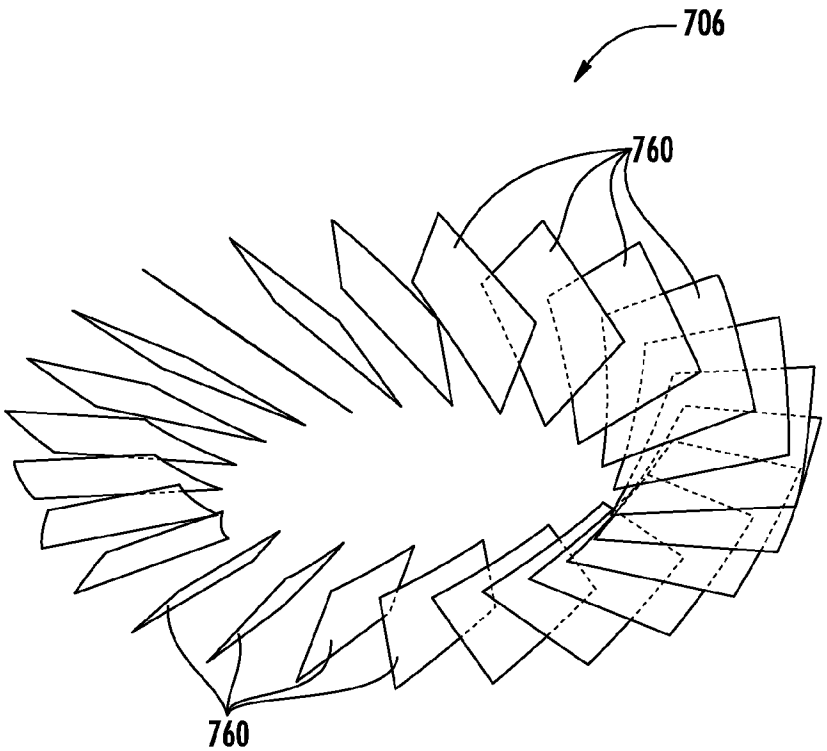
FIG. 24 is a perspective view of the vanes of the classifier of FIG. 21.

The vane assembly 706 includes a plurality of blades 760 that are configured to influence the flow of the fluid and particle mixture passing through the vane assembly. For example, the vane assembly 706 may include 24 blades 760 (as shown in FIGS. 24-26) aligned in a radial alignment (e.g., clockwise alignment) at substantially similar offset distances around the outer diameter of the stationary body 707 and the inner diameter of the housing 702. However, the vane assembly 706 may include any number of blades, which may be aligned at similar or uniquely offsetting distances. Each blade 760 of the vane assembly 706 may be angled at a pitch angle relative to horizontal, vertical, and/or to a plane, such as a plane defined by a lower surface 761 (e.g., the entrance) of the vane assembly 706. The pitch angle may be any angle, such as, for example, between approximately thirty-five (35) and forty-five (45) degrees.

As shown in FIG. 21, the stationary body 707 is disposed within the housing 702 and is configured to help control (e.g., influence) the flow of the fluid and particle mixture through the classifier 701. As shown in FIG. 28, the stationary body 707 includes an upper portion 771 and a lower portion 772. The lower and upper portions 772, 771 may be configured having conical (e.g., frusto-conical) shapes. The conical portions 771 and 772 may be provided in opposing arrangement and configured to converge as each portion extends away from the opposing portion, such as to form generally a diamond shape. Each conical portion 771, 772 may include an inclination angle, which may be similarly or differently configured relative to the other conical portion. The inclination angle is related to the aspect ratio (e.g., the length over the diameter of each conical portion and/or the stationary body 707 itself), and may be configured so as to tailor the fluid flow through the classifier 701.

The stationary body 707 may also include a cylindrical portion 773, which may be provided between the opposing conical portions 771, 772, where each conical portion extends away from an end of the cylindrical portion 773. Moreover, each conical portion 771, 772 may extend away from the cylindrical portion 773 in a converging manner. The stationary body 707 may also include additional portions. As shown in FIG. 28, the stationary body 707 includes a bottom portion 774 that is provided below the second conical portion 772, where the bottom portion 774 has a generally cylindrical shape. In other words, the bottom portion 774 may extend in a downward direction from a lower end of the lower conical portion 772 (e.g., the end of the conical portion having the smaller diameter). Additionally, the bottom portion 774 may help define the second outlet opening 727 (e.g., the second reclaim outlet) provided in the classifier 701. The second outlet opening 727 may serve as an outlet for generally downward flowing pre-classified heavy coarse particles to re-enter the grinding zone.

The classifier may include one or more than one chamber for the fluid to flow therethrough. FIG. 28 illustrates the flow of fluid through the classifier 701, and the various chambers therein, using arrows FF, and further illustrates the flow of reclaimed coarse particles using arrow PF. As shown in FIG. 28, the classifier 701 includes a first chamber 711 (e.g., first chamber portion), a second chamber 712 (e.g., second chamber portion), and a third chamber 713 (third chamber portion), where the fluid and particle mixture are configured to flow through the chambers. As shown in FIG. 33, the first chamber 711 may be configured to serve a dual purposes of pre-classification and pulverization. For example, the portion 774 may serve as the feed pipe for introducing a material, such as for raw coal, into the pulverizing chamber. Thus, the body 707 may be configured as a feed pipe with its interior being a chamber for introducing the material into the pulverizer. The first chamber 711 may be fluidly connected (e.g., in fluid communication) with this pulverizing chamber, such that pre-classified coarse particles may be separated from the fluid flow and directed through the first chamber to be reground in the pulverizer.

The first chamber 711 may be provided between an inner surface of the housing 702 and the outer surface of the stationary body 707, another portion or surface of the housing 702, and/or another intermediate (e.g., intervening) member. For example, a first portion of the first chamber 711 may be provided between the inner surface of the lower portion 722 and a section of a wall 726, such as where the fluid and particle mixture enters the first chamber 711 from the inlet 720. Also, for example, a second portion of the first chamber 711 may be provided between the lower conical portion 772 and/or bottom portion 774 and a section of the wall 726, such as where the fluid and particle mixture exits the first chamber 711 to pass through the vane assembly 706.

In the first chamber 711, pre-classification of the fluid and particle flow may occur, for example, through gravity and without swirl. Gravity may influence the heavy coarse particles downward after entering the second portion of the first chamber 711 to be reclaimed through the second outlet opening 727. For example, the initial change in direction from the inlet 720 inward toward the first chamber 711 and body 707 may cause some coarse particles to fall to the second outlet opening 727, such as, after colliding with the body 707, the blades 760 of the vane assembly 706, and/or other particles.

The classifier may also include a ring member that is configured to improve the pre-classification of the fluid and particle flow, such as prior to entering the vane assembly. As shown in FIG. 33, the classifier 901 includes a ring member 965 that is configured to provide enhanced pre-classification in the first chamber of the classifier 901. The ring member 965 may include one or more rings (e.g., annular members), where each ring may act as a particle deflector by deflecting coarse particles in a generally downward direction toward the pulverizing chamber and may also influence the fluid flow, such as by acting as a flow straightener to provide a generally uniform well dispersed particle flow upward into the vanes (e.g., swirler vanes) of the vane assembly. As shown, the ring member 965 includes three spaced apart rings aligned at a pitch angle relative to the longitudinal direction (and/or an inlet end of the vane assembly).

Figure 34:
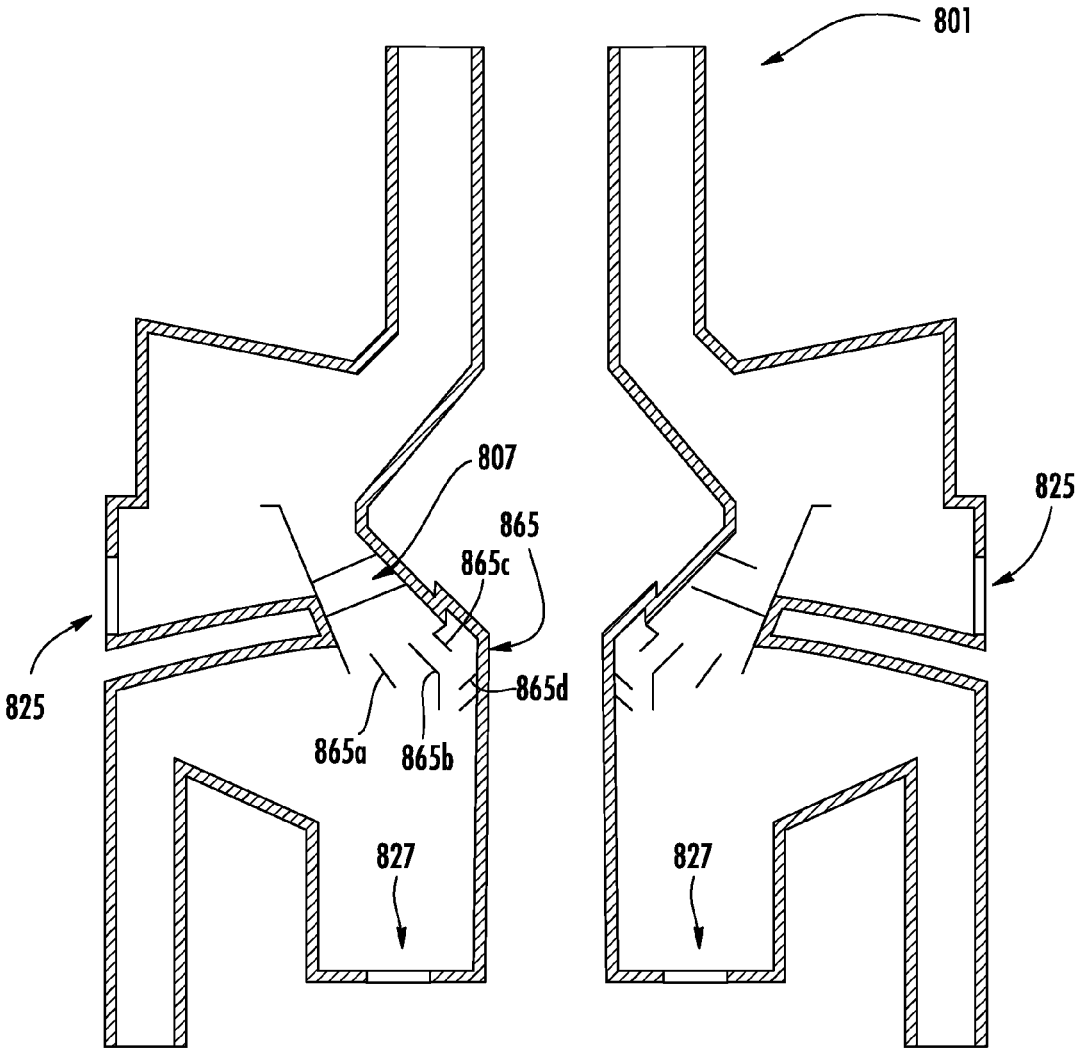
FIG. 34 is a cross-sectional view of a classifier including a ring member, according to another exemplary embodiment.

Another exemplary embodiment of a ring member 865 is shown in FIG. 34 in the classifier 801. As shown, the ring member 865 includes four elements. However, the ring member 865 may be configured to include one element, more than four elements, or any combination of the elements shown. The first element is the ring 865*a*, which is shown as the outer most element (e.g., relative to the body). The ring 865*a* may include a portion having a conical shape (e.g., frusto-conical) with a generally linear cross-section aligned at an oblique angle, such as relative to an inner wall of the classifier (e.g., the bottom portion of the body). The second element is the ring 865*b*, which is shown as the ring provided inward of the ring 865*a*. The ring 865*b* may include a first portion having a conical shape and a second portion having a cylindrical shape that is disposed below the first portion. The third element is the ring 865*c*, which is shown as the ring provided adjacent to an inner wall of the classifier, such as the lower conical portion of the body. The ring 865*c* may include a portion having a conical shape, which may extend generally parallel or at an oblique angle to the adjacent portion. The ring 865*c* may also include a connecting portion that extends from the conical portion, which may connect the ring 865*c* to the body. The fourth element is the ring 865*d*, which is shown as the ring that extends from the bottom portion (e.g., the cylindrical portion) of the body. The ring 865*d* may have one or more conical shaped portions, which may be configured generally parallel or at an angle relative to the other portions. As shown, the ring 865*d* includes two conical portions that are generally parallel and offset from the other portion by a distance of separation. Each portion of the ring 865*d* is configured at a first angle relative to the bottom portion of the body and at a second angle relative to the ring 865*a*.

The rings 865*a* and 865*b* of the ring member 865 may pre-classify the fluid and particle flow through the classifier and/or may provide for coal powder redistribution. For example, the rings 865*a* and 865*b* may make coal particle distribution uniform for entering the vanes of the vane assembly of the classifier. The ring 865*c* may kick particles into the main air flow. The ring 865*d* provides pre-classification by keeping relatively coarse particles from passing through the vane assembly. The ring 865*d* may also direct the reclaimed coarse particles back down to the pulverizing chamber, such as through the reclaim outlet 827 (e.g., second reclaim outlet). Coarse particles that pass through rings are further classified (e.g., post-classified) via the vane assembly 807 and after separation may be directed back to the pulverizer through the reclaim outlet 825 provided in a sidewall of the housing.

Returning now to the embodiment shown in FIGS. 21-32, the second chamber 712 may be provided between an inner surface of the housing 702 and an outer surface of the stationary body 707. For example, the second chamber 712 may be provided between the inner surface of the upper portion 721 and an outer surface of the conical portion 771 and/or the cylindrical portion 773. The fluid and particle mixture may enter the second chamber 712 from the vane assembly 706 and may exit the second chamber 712 to the third chamber 713.

In the second chamber 712, additional classification of the fluid and particle flow may occur, for example, through centrifugal forces (e.g., swirl), particle trajectory, or a combination thereof. For example, classification may occur by ejecting the particles in a trajectory toward the outer diameter and/or by centrifugal forces flinging particles to the outer diameter. Swirl caused by the vane assembly 706 may influence the separation of the coarse and the fine particles, allowing the fine particles to pass from the second chamber 712 to the third chamber 713, while influencing the coarse particles to exit the one or more openings 725 to be reclaimed.

The third chamber 713 may be provided in the base 740 of the outlet 704. For example, the base 740 may be annular shaped including an outer surface and an inner surface that define the third chamber 713. The outer surface may be conical shaped or may have another suitable shape. The inner surface may be cylindrical shaped or may have another suitable shape. The inner surface may be integrally formed with the base 740, formed separately from the base 740 and coupled thereto, or may have another suitable configuration.

For example, the inner surface may be integrally formed with the stationary body 707, and may be another portion extending from the upper conical portion 771.

In the third chamber 713, fine particles and fluid are conveyed downstream, such as to a downstream process. In other words, the classification of the particles occurs in the first and second chambers 711, 712, and the remaining fine particles flow through the third chamber 713 to exit the classifier 701.

Figure 23:
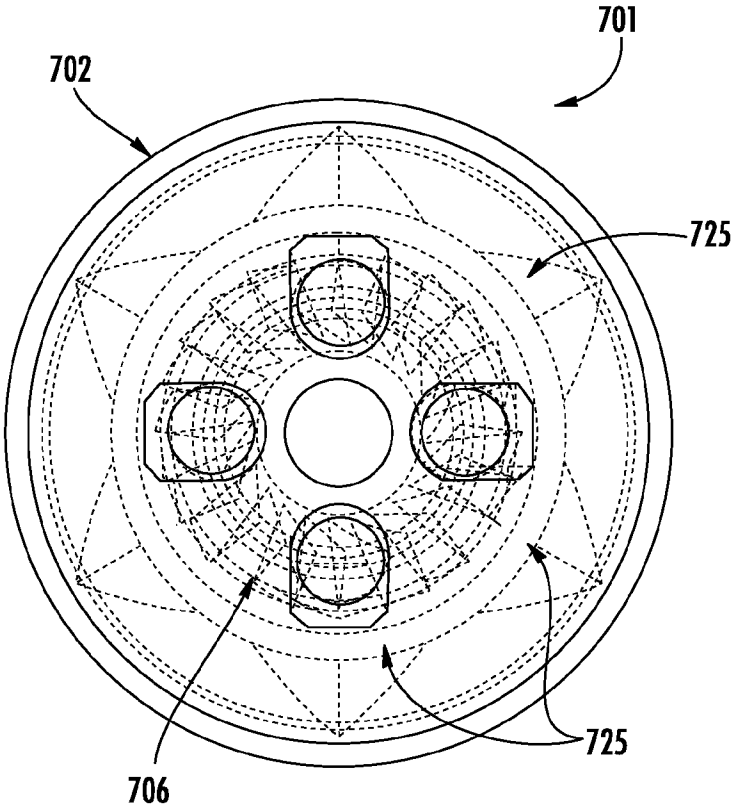
FIG. 23 is a top view of the classifier of FIG. 21.
Figure 27:
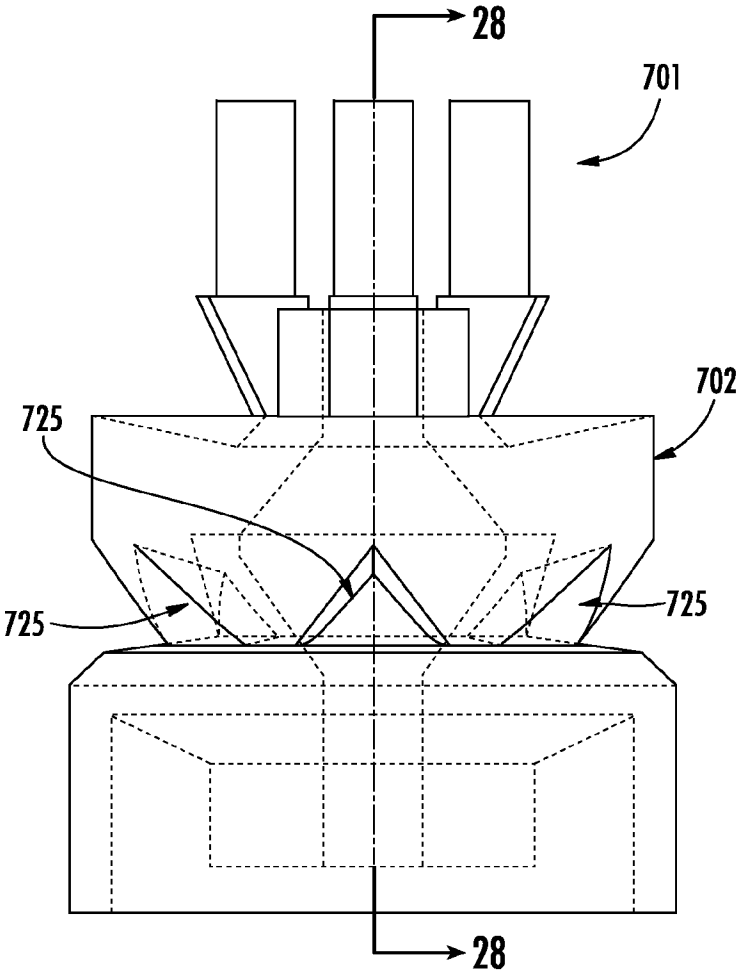
FIG. 27 is a side view of the classifier of FIG. 21 with the vanes removed for clarity.

The housing 702 may include a reclamation zone, which recovers the particles (e.g., the coarse particles) that are separated from the fluid and particle flow by the classifier (e.g., the classifier 701). For example, the classifier 701 may include an opening, such as in the housing 702 for the coarse particles to exit the classifier 701, such as for additional reprocessing (e.g., regrinding by a pulverizer). As shown in FIGS. 23 and 27, the classifier 701 may include a plurality of offset (e.g., spaced-apart around a periphery of the housing 702) openings 725 (e.g., six openings having a generally hexagonal arrangement) in the housing 702, where each opening 725 is configured to exit the coarse particles from the classifier 701. For example, each opening 725 may be provided in the housing 702 at a location that is adjacent to the second chamber 712, so that the coarse particles exiting the vane assembly 706 are directed toward the outer wall to be reclaimed through an opening 725.

The classifier 701 may include a chute 708 that is configured to extend from one (or more than one) opening 725 in the housing 702. The classifier 701 may include a plurality of chutes 708 (e.g., three chutes, four chutes, six chutes, etc.) disposed around the housing 702, where each opening 725 has a corresponding chute 708 extending therefrom. The chute 708 may be configured to convey reclaimed particles (e.g., relatively coarse particles) separated from the fluid flow.

Each chute 708 may include a movable door (not shown) that is configured to allow reclaimed coarse particles to exit the chute 708, such as to reenter the pulverizer. For example, each door (of each chute 708) may be movable between an open position and a closed position to either prevent or allow the coarse particles to exit the opening 725 in the housing 702. Thus, each chute 708 may be self-sealing, such as when its door in the closed position to prevent external fluid (e.g., air) from entering the classifier 701 (e.g., the second chamber 712) through the opening 725. External fluid entering through the chute 708 may interfere with the dead zone, which may form in the second chamber 712, and therefore may reduce the efficiency of the classifier 701 to separate the coarse and fine particles.

The classifier 701 may also include a chute, a conveyor, or another suitable structural member that is configured to convey or transport the reclaimed particles (e.g., the coarse particles) to the pulverizer for regrinding (or another suitable device). For example, the classifier 701 may include a chute configured to be in fluid communication with each opening 725 to convey the particles reclaimed through the respective opening 725.

The flow of the fluid and particle mixture (e.g., comprising both fine and coarse particles) enters the classifier 701 through the inlet (e.g., the inlet opening 720), then passes through the first chamber 711 and into the vane assembly 706. The vane assembly 706 induces swirl that helps in combination with the shape of the stationary body 707 to classify the fluid and particle mixture by separating the fine and coarse particles. For example, the stationary body 707 may include a sharp change in direction, which combined with (or without) the swirl, may induce the coarse particles to exit the vane assembly 706 generally near the outer wall (e.g., the housing 702) and become entrenched in a dead zone in the outer portion of the second chamber 712. The coarse particles then may fall to the openings 725 in the housing 702 to be reclaimed. Also, for example, the fine particles may, for example, exit the vane assembly 706 generally closer to the inner wall (e.g., the stationary body 707), and may exit directed generally in an upward direction toward the third chamber 713 of the outlet 704 to be directed to a downstream process or device.

Figure 30:
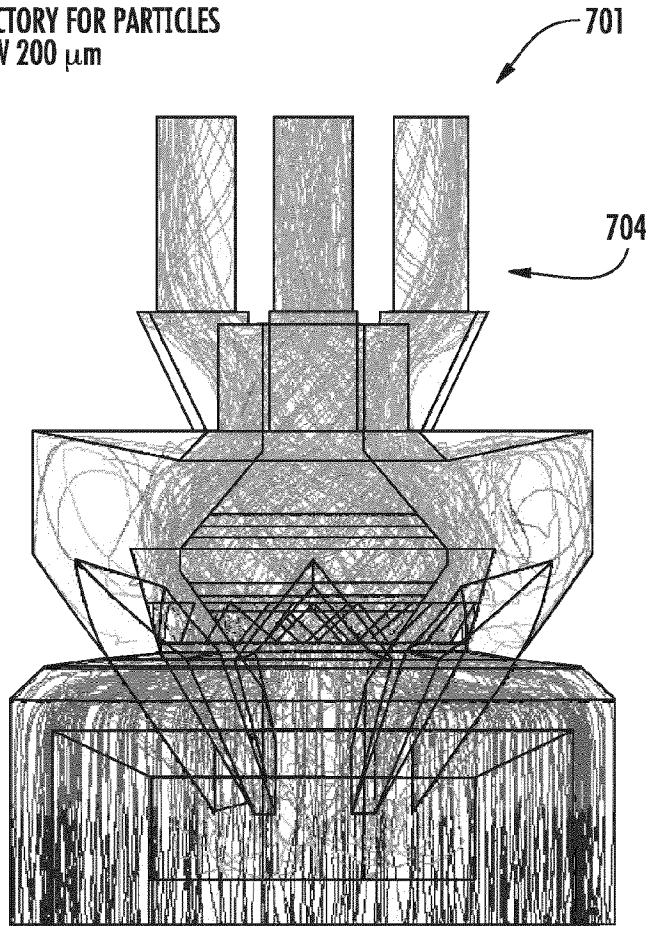
FIGS. 29-32 are various views showing computer generated analysis of the particle trajectories for particles having the specified sizes.
Figure 29:
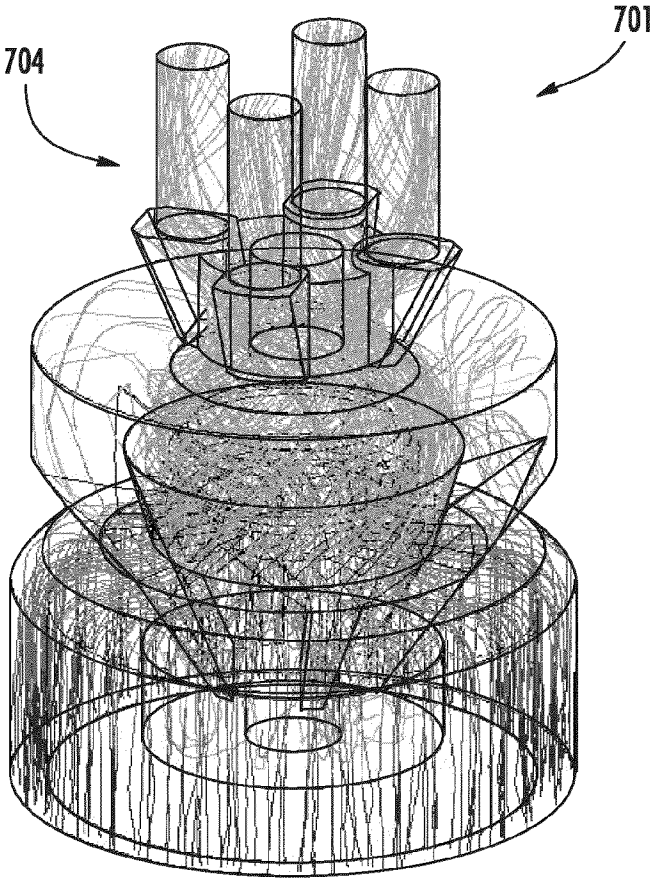
Figure 32:
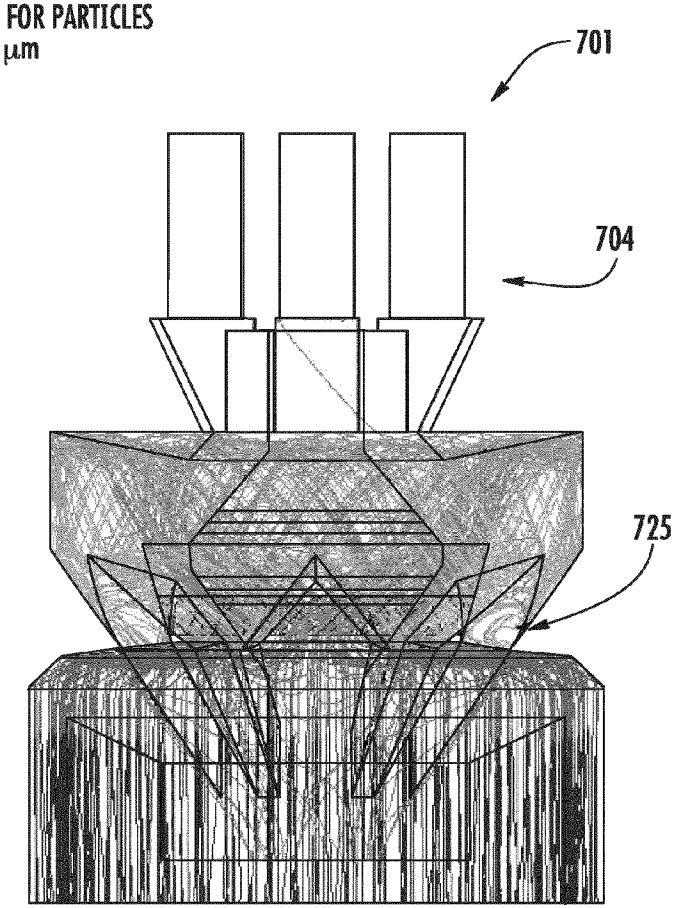
Figure 31:
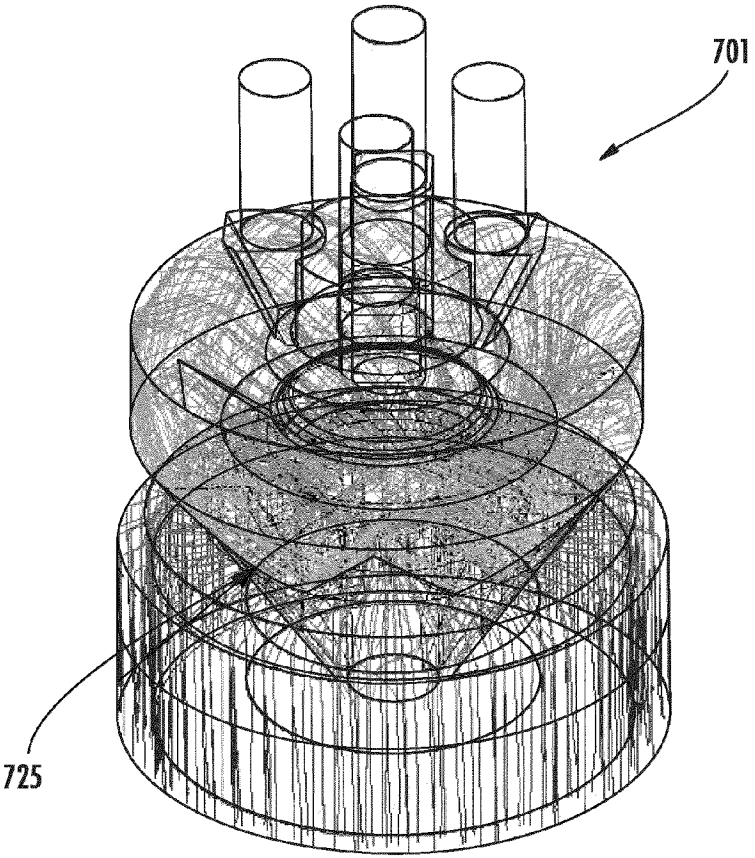

FIGS. 29-32 illustrate the results of computer generated models using CFD analyzing the particle trajectories for particles through a classifier modeled to represent the classifier 701. FIGS. 29 and 30 show the predicted results of the trajectories of particles having sizes below 200 micrometers, and FIGS. 31 and 32 show the predicted results of the trajectories of particles having sizes greater than 200 micrometers. As shown in FIGS. 29 and 30, substantially all of the particles having sizes less than 200 micrometers are allowed to pass through the outlet 704 of the classifier 701 (and onto the downstream process, such as to be combusted) with very few fine particles being reclaimed. As shown in FIGS. 31 and 32, substantially all of the particles having sizes greater than 200 micrometers are separated from the fluid flow and reclaimed through the openings 725 in the housing 702 of the classifier 701 (and, for example, sent to the pulverizer for regrinding). Accordingly, very few coarse particles are allowed to exit the outlet 704 of the classifier.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the classifiers as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present invention. For example, an element, feature, or component of one embodiment may be used with any other embodiment disclosed herein.

What is claimed is:

1. A classifier for separating fine and coarse particles in a fluid flow, comprising:

a housing extending along a longitudinal axis between a first end and an opposing second end, the housing including:

a lower portion provided at the first end and including an inlet for receiving the fluid flow;

an upper portion provided at the second end and including a reclaim outlet; and an intermediate portion provided between the upper and lower portions;

a body disposed within the housing that defines a chamber between the body and the housing;

a vane assembly provided between an outer surface of the body and an inner surface of the intermediate portion of the housing, such that the vane assembly divides the chamber into a first chamber provided between the body and the lower portion and a second chamber provided between the body and the upper portion, wherein the vane assembly includes a plurality of blades aligned at a pitch angle relative to an entrance end of the vane assembly; and an outlet provided at the second end and fluidly connected to the second chamber to allow the fine particles separated from the coarse particles to flow through the outlet after exiting the vane assembly;

wherein the reclaim outlet is fluidly connected with the second chamber and a pulverizer to allow the coarse particles separated from the fluid flow after exiting the vane assembly to be directed back to the pulverizer for regrinding;

wherein the body includes opposing upper and lower frusto-conical portions; and wherein the lower fusto-conical portion is provided adjacent to the intermediate portion of the housing with the vane assembly therebetween, such that a spacing between the lower frusto-conical portion and the intermediate portion narrows from the entrance end of the vane assembly to an exit end of the vane assembly.

2. The classifier of claim 1, wherein each of the lower and upper portions of the housing are generally cylindrical in shape having a diameter, and wherein the intermediate portion has a smaller diameter relative to the diameters of the lower and upper portions.

3. The classifier of claim 1, wherein the lower portion of the housing further includes a second reclaim outlet, an outer wall, an inner wall, and an intermediate wall provided between the inner and outer walls and separating the first chamber into an inner first chamber and an outer first chamber.

4. The classifier of claim 3, wherein the inlet is provided between the outer wall and the intermediate wall and is fluidly connected to the outer first chamber, wherein the second reclaim outlet is provided between the inner wall and the intermediate wall and is fluidly connected with the pulverizer to direct coarse particles back to the pulverizer for regrinding.

5. The classifier of claim 1, wherein the reclaim outlet is provided in a bottom wall of the upper portion of the housing, and wherein the second chamber is fluidly connected to the outlet between the upper frusto-conical portion and an upper wall of the upper portion of the housing.

6. The classifier of claim 5, further comprising an outlet pipe that is fluidly connected to the outlet and a furnace configured to combust the fine particles passing from the outlet pipe to the furnace.

7. A classifier for separating fine and coarse particles in a fluid flow, comprising:

a housing having a first end, a second opposing end, and an inlet opening provided at the first end to introduce the fluid flow into the classifier;

an outlet pipe provided at the second end and configured to be fluidly connected to a furnace;

an inner casing provided in the housing and fluidly connected to the inlet opening, such that a first chamber is provided between an outer surface of the inner casing and an inner surface of the housing;

a body disposed within the housing having a streamlined lower portion that is provided within the inner casing, such that a second chamber is provided between an outer surface of the lower portion of the body and an inner surface of the inner casing; and a reclaim outlet provided at the first end and fluidly connected to the first chamber;

wherein the classifier is configured such that coarse particles are directed to the first chamber and out of the reclaim outlet and the fine particles are directed out of the outlet pipe;

wherein the inner casing and the lower portion of the body each include a portion having an increasing cross-sectional size when moving in a longitudinal direction from the first end toward the second end; and wherein the lower portion of the body is provided adjacent to the portion of the inner casing.

8. The classifier of claim 7, wherein the lower portion of the body and the adjacent portion of the inner casing each have a conical shape.

9. The classifier of claim 8, wherein the conical portion of the body is provided at an angle relative to the conical portion of the inner casing, such that the second chamber has a decreasing cross-sectional size when moving from an entrance of the second chamber toward an exit of the second chamber.

10. The classifier of claim 9, further comprising a vane assembly provided between the conical portion of the body and the conical portion of the inner casing, wherein the vane assembly includes a plurality of blades radially arranged around the vane assembly.

11. The classifier of claim 10, wherein each blade has an inner end coupled to the conical portion of the body and an outer end coupled to the conical portion of the inner casing, and wherein each blade has an increasing length between the inner and outer ends when moving from the entrance of the second chamber toward the exit of the second chamber.

12. The classifier of claim 11, further comprising an inlet pipe provided at the first end of the housing, wherein the inlet pipe is fluidly connected to the inlet opening of the housing and is configured to receive the fluid flow from a pulverizer.

13. The classifier of claim 12, further comprising a second vane assembly provided in the inlet pipe, wherein the second vane assembly includes a plurality of blades having a radial arrangement.

14. A method for separating fine particles and coarse particles in a fluid flow, comprising the steps of:

introducing the fluid flow having fine and coarse particles into an inlet pipe provided at a first end of a housing;

directing the fluid flow from the inlet pipe into an inner casing that is fluidly connected to the inlet pipe;

directing the fluid flow through a vane assembly that is provided between an inner portion of the inner casing and an outer portion of a streamlined body provided within the inner casing, wherein the vane assembly includes a plurality of vanes having a pitch angle relative to an entrance end of the vane assembly to induce the fluid flow to swirl to separate the fine and coarse particles;

directing the coarse particles into a chamber between the housing and the inner casing to pass through a reclaim outlet provided at the first end of housing between the housing and the inlet pipe; and directing the fine particles into an outlet pipe provided at a second end of the housing that is opposite the first end;

wherein the inner casing includes a portion having an increasing cross-sectional size and the body includes a portion having an increasing cross-sectional size when moving in a longitudinal direction from the first end toward the second end; and wherein the portions of the inner casing and the body are provided adjacent to one another between the vane assembly and the inlet pipe defining a second chamber.

15. The method of claim 14, wherein the portion of the inner casing has a conical shape and the portion of the body has a conical shape, and wherein the conical portion of the inner casing is provided at an angle relative to the conical portion of the body, such that the second chamber narrows in a converging manner moving from the inlet pipe toward the vane assembly.

16. The method of claim 15, wherein the converging manner of the second chamber has a generally V-shaped cross-section, which in combination with the vane assembly induce a swirl and direct the coarse particles in the fluid flow outward to a dead zone in a portion of the first chamber that is outside the vane assembly and the inner casing.

17. The method of claim 16, wherein the reclaim outlet is fluidly connected with a pulverizer, such that the coarse particles are directed from the reclaim outlet to the pulverizer for regrinding.

18. The method of claim 17, wherein the fine particles are directed from the outlet pipe into a furnace to combust the fine particles.

* * * * *